US007419257B2

(12) United States Patent
Mouri et al.

(10) Patent No.: US 7,419,257 B2
(45) Date of Patent: Sep. 2, 2008

(54) INK JET RECORDING METHOD AND INK JET RECORDING APPARATUS

(75) Inventors: Akihiro Mouri, Tokyo (JP); Hiroshi Taniuchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 395 days.

(21) Appl. No.: 11/136,382

(22) Filed: May 25, 2005

(65) Prior Publication Data

US 2005/0270351 A1 Dec. 8, 2005

(30) Foreign Application Priority Data

Jun. 3, 2004 (JP) ..... 2004-166366

(51) Int. Cl.
*B41J 2/01* (2006.01)
*B41M 5/00* (2006.01)
*B41C 1/10* (2006.01)

(52) U.S. Cl. ..... 347/103; 347/102; 347/15; 347/55; 347/47; 347/63; 427/263; 427/555; 427/288; 427/474

(58) Field of Classification Search ..... None
See application file for complete search history.

(56) References Cited

U.S. PATENT DOCUMENTS 4,438,156 A 3/1984 Homola et al.
5,099,256 A 3/1992 Anderson
5,619,234 A * 4/1997 Nagato et al. ..... 347/55
5,790,160 A * 8/1998 Reeves et al. ..... 347/103
6,196,675 B1 * 3/2001 Deily et al. ..... 347/103
6,354,700 B1 * 3/2002 Roth ..... 347/103
6,385,405 B1 * 5/2002 Kingsland ..... 399/2
6,862,992 B2 * 3/2005 Nakazawa et al. ..... 101/466
6,902,249 B2 6/2005 Suzuki et al.
2003/0068571 A1 * 4/2003 Uehara et al. ..... 430/126
2003/0103123 A1 * 6/2003 Snyder ..... 347/102
2004/0036754 A1 * 2/2004 Tanikawa et al. ..... 347/103
2006/0050123 A1 * 3/2006 Wada et al. ..... 347/103
2006/0152566 A1 7/2006 Taniuchi et al.

FOREIGN PATENT DOCUMENTS

JP 62-92849 4/1987
JP 6-40025 2/1994

(Continued)

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

An ink jet recording method and an ink jet recording apparatus permitting image formation with a high degree of color reproducibility while alleviating the influences of the ink-absorbency of the recording medium and the base color is to be provided. A transfer drum is applied a reaction liquid, and inks of different colors are applied by recording heads to the area applied the reaction liquid to form a coagulated ink image on the transfer drum. Ahead of the step to transfer this coagulated ink image to the recording medium, white ink is applied to at least the area of the transfer drum to which ink dots are to be applied or at least the area to which ink dots are to be applied out of the area of the recording medium to which the coagulated ink image is to be transferred.

9 Claims, 7 Drawing Sheets

FOREIGN PATENT DOCUMENTS

| | | |
|---|---|---|
| JP | 6-199032 | 7/1994 |
| JP | 7-133451 | 5/1995 |
| JP | 2000-318300 | 11/2000 |
| JP | 2001-253065 | 9/2001 |
| JP | 2002-038063 | 2/2002 |
| JP | 2003-025554 | 1/2003 |
| JP | 2003-285427 | 10/2003 |

* cited by examiner

INK JET RECORDING METHOD AND INK JET RECORDING APPARATUS

BACKGROUND OF THE INVENTION

1. Field of the Invention

The present invention relates to an ink jet recording method and an ink jet recording apparatus, and more particularly to an ink jet recording method and an ink jet recording apparatus by which an ink image is formed on an intermediate transfer body having an ink-repellent surface layer and that ink image is transferred to a recording medium to achieve recording.

2. Description of the Related Art

Recording systems for image recording apparatuses in current use for recording and outputting computer-drawn images, copied images from printed matters, facsimile images and the like as required by the user include ink jet, electron-photographic, thermal head and dot impact systems.

Of these systems, the ink jet recording system, by virtue of its relatively simple hardware configuration, has many advantages including a low running cost, the ease of reducing the hardware size and color recording/printing, and adaptability to many different recording medium dimensions from card size to large poster size. Because of these advantages, ink jet recording apparatuses are now attracting keen interest. In particular, ink jet printers, which are available in the market at relatively low prices, are found highly suitable for use with personal computers, digital cameras and so forth. The ink jet recording system is used not only in printers but also in output devices for office automation equipment including facsimile machines and copying machines.

Such an ink jet recording method provides low-noise printing systems, among which the main stream consists of a system whereby which ink is directly ejected onto a material to print as a recording medium, which may be a paper, cloth, plastic sheet or the like, according to image signals to print characters, images and so forth (also known as a direct ejection system). Also, the ink jet recording method, which requires no plate in the printing process, can efficiently print even a small number of copies, and is expected also for industrial use, which requires capability of forming images on a wide variety of recording media. However, the direct ejection system, which constitutes the main stream today, cannot satisfy this requirement. Thus, ink jet recording by the direct discharge system is subject to strict constraints on the choice of the recording medium.

One of its specific constraints is the effect of the ink-absorbency of the recording medium.

The predominant constituent of ink used for ink jet recording is liquid. Therefore, differences in ink-absorbency and permeability of the recording medium affect the reproducibility of the image. Especially a recording medium absorbing no liquid (non-ink-absorbent medium) is subject to a phenomenon in which ink droplets printed adjacently become mixed (bleeding) or another phenomenon of earlier impacting ink droplets being drawn by later impacting ones (beading). Therefore image formation is extremely difficult. Even an ink-permeable recording medium, if its liquid-absorbency (ink-absorbency) is low, would be subject to not only beading and/or bleeding but also a phenomenon known as feathering, in which ink permeates along fibers within the recording medium and accordingly oozes along the fibers, resulting in a poor image. Increasing the ink-absorbency of the recording medium would alleviate these problems, but this could invite penetration of ink (to the rear face of the recording medium).

Many attempts to solve these problems have been proposed by what is known as a transfer system, by which an ink image is temporarily formed on an intermediate transfer body by ink jet recording, the viscosity of that ink image on the intermediate transfer body is increased along with the drying of the ink, or the solvent of the ink image is removed, to concentrate the ink, and then the ink image is transferred from the intermediate transfer body to a recording medium (see U.S. Pat. Nos. 4,438,156 and 5,099,256 and Japanese Patent Application Laid-Open No. 62-92849 (1987)). These proposed methods differ from conventional ink jet recording by which an image is formed by printing directly on a recording medium and causing the moisture of the ink to permeate the recording medium. Therefore, they can be effective against feathering.

Incidentally, not only recording paper specifically intended for ink jet recording use but also plain paper commonly used for electrophotographic copying machines is often used as the recording medium for the formation of color images by ink jet recording. Plain paper is produced by many manufacturers, and the quality and hue of even white paper subtly differ from one manufacturer to another. Moreover, recycled paper is in expanding use today, a circumstance that contributes to further increasing hue differences among recording media. In addition, ink jet recording on a wide variety of recording media, including those on which a color and/or a pattern are printed in advance and those having transparent base, has come to be required.

An image formed on one of these diverse recording media is considerably influenced by the color and pattern of that particular recording medium. In view of this problem, it is proposed to use white ink for recording on any non-white recording medium (see Japanese Patent Application Laid-Open No. 2001-253065). More specifically, Japanese Patent Application Laid-Open No. 2001-253065 discloses a technique by which inks of a plurality of colors including white are made ready for use, the level of whiteness of the recording medium is determined, and white ink in addition to color inks (cyan, magenta, yellow and black) is used for image formation on a medium whose level of whiteness is below a specified level (i.e. a non-white medium).

However, the system disclosed by this Japanese Patent Application Laid-Open No. 2001-253065 uses no intermediate transfer body but directly applies color inks for image formation to a recording medium. Therefore it is unsuitable for recording media which are poor in ink absorbency as discussed above. If the method of Japanese Patent Application Laid-Open No. 2001-253065 is applied to, for instance, a low ink-absorbency recording medium, the white ink and color inks will become mixed on the recording medium, and the white portion, which should be an undercoat, will be distorted, hardly serving as an undercoat.

Considering these factors, it is desirable to work out an image formation system that permits white undercoating while using an intermediate transfer body. Such an image formation system is realized by a technique disclosed in Japanese Patent Application Laid-Open No. 2003-25554.

According to this Japanese Patent Application Laid-Open No. 2003-25554, high molecular granules which can be dissolved in, or inflated by the moisture of, ink are formed in advanced on an intermediate transfer body, and droplets of color inks (cyan, magenta, yellow and black) are jetted from an ink jet recording head onto the intermediate transfer body on which the granules are formed to generate a visible image. After forming along with that a white background is formed by jetting white ink onto the non-image portion where this visible image is not generated, the image and the white background are transferred to the recording medium.

However, the technique according to Japanese Patent Application Laid-Open No. 2003-25554, as no white ink is applied to the portion where no visible image is formed, involves a problem that the influences of the color and pattern of the recording medium in the undercoat portion for the visible image cannot be sufficiently alleviated.

As is evident from the foregoing description, no proposal has been made as yet of a technique by which, while making it possible to form an image on a low ink-absorbency recording medium, the influences of the color and pattern of the recording medium in the undercoat portion for the formed image can be sufficiently alleviated. As a consequence, the advantages of the ink jet recording system including printing ease and adaptability to small number of copies printing are not yet fully utilized in industrial applications.

SUMMARY OF THE INVENTION

An object of the present invention is to provide an ink jet recording method and an ink jet recording apparatus permitting image formation with a high degree of color reproducibility while alleviating the influences of the ink-absorbency of the recording medium and the color of the undercoat.

According to a first aspect of the present invention, there is provided an ink jet recording method comprising: a first applying step of applying ink to an intermediate transfer body with a first recording head according to image data, a transferring step of transferring the ink applied to said intermediate transfer body to a recording medium, a treating step of carrying out, ahead of said transferring step, treatment to reduce the fluidity of the ink to be applied to said intermediate transfer body, and a second applying step of applying, ahead of said transferring step, a white material to at least part of a first area to which said ink is to be applied on said intermediate transfer body or to at least part of a second area to which said ink is to be transferred on said recording medium.

According to a second aspect of the present invention, there is provided an ink jet recording method comprising: a step of applying liquid containing a component which coagulate color materials in ink to an intermediate transfer body; a step of applying ink to the intermediate transfer body to which said liquid has been applied, with a recording head according to image data; a step of applying a white material to at least part of an area to which said ink is to be applied on said intermediate transfer body; and a step of transferring the ink and the white material applied to said intermediate transfer body to a recording medium.

According to a third aspect of the present invention, there is provided an ink jet recording method comprising: a first applying step of applying ink to an intermediate transfer body with a first recording head according to image data; a transferring step of transferring the ink applied to said intermediate transfer body to a recording medium; and a second applying step of applying, ahead of said transferring step, a white material to at least part of an area to which said ink is to be transferred on said recording medium.

According to a fourth aspect of the present invention, there is provided an ink jet recording apparatus comprising: means for applying a material to coagulate color materials in ink to an intermediate transfer body; means for applying ink to the intermediate transfer body to which said liquid has been applied according to image data; a transferring portion for transferring ink applied to said intermediate transfer body to a recording medium; and means for applying a white material to at least part of an area to which said ink is to be applied on said intermediate transfer body, the white material applying means being arranged opposite said intermediate transfer body and in a upstream position from said transferring portion.

According to a fifth aspect of the present invention, there is provided an ink jet recording apparatus comprising: means for applying ink to an intermediate transfer body according to image data; transferring portion for transferring ink applied to said intermediate transfer body to a recording medium; and means for applying a white material to at least part of an area to which said ink is to be transferred on said recording medium, the white material applying means being arranged upstream from said transferring portion on a carriage path along which said recording medium is carried to said transferring portion.

In a mode of implementing the present invention, an image is formed by applying ink with a recording head to an intermediate transfer body by using a method of reducing the fluidity of the ink (for instance by accelerating the drying of the ink image formed on the intermediate transfer body, reducing the moisture of the ink image on the intermediate transfer body, or applying a reaction liquid which coagulates color materials in ink). This enables an ink image suppressed in beading and/or bleeding to be formed on the intermediate transfer body. Further, ahead of the transferring step, a white material (e.g. white ink) is applied to at least a first area in which ink dots are formed on the intermediate transfer body or to at least a second area to which the ink dots are transferred on the recording medium. This makes possible reducing the influences the color, pattern and other factors of the recording medium or to highlight the image formed on the recording medium. As a result, an image excelling in color reproducibility can be obtained.

The above and other objects, effects, features and advantages of the present invention will become apparent from the following description of embodiments thereof taken in conjunction with the accompanying drawings.

DETAILED DESCRIPTION OF PREFERRED EMBODIMENTS

Embodiments of the present invention will be described in detail with reference to the accompanying drawings.

First Embodiment

In this embodiment, white ink used to alleviate the color and pattern of the recording medium or to highlight the image formed on recording medium is applied to a transfer drum, which functions as an intermediate transfer body, between a step of applying a reaction liquid on to the transfer drum and a transfer step.

Figure 1:
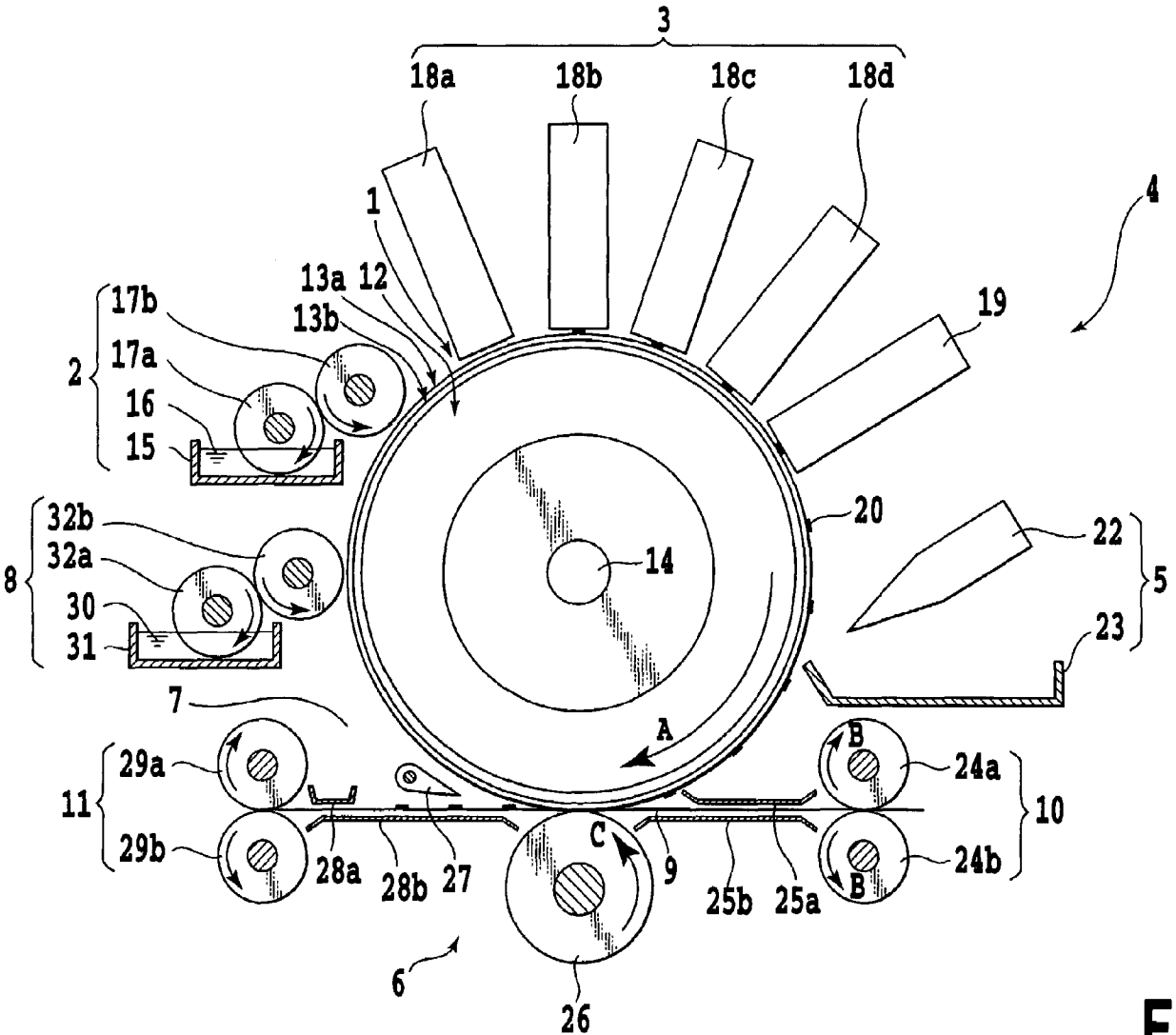
FIG. 1 is a schematic diagram illustrating the configuration of the image formation unit of an ink jet recording apparatus, in accordance with an embodiment of the present invention.

FIG. 1 is a schematic diagram illustrating the configuration of the image formation unit of an ink jet recording apparatus, which embodies the invention in this mode.

Referring to FIG. 1, a transfer drum 1 is an intermediate transfer body having a releasable surface layer. This transfer drum 1 is supported on a shaft (not shown) and can be driven by a drum drive unit (not shown) to turn in the direction of arrow A. Along the circumference of the transfer drum 1, there are arranged from the upstream to the downstream side in the following order a reaction liquid application unit 2 as reaction liquid applying means to apply a reaction liquid for coagulating the color materials of inks, an image formation unit 3 as image forming means to apply inks, a white ink painting unit 4 as means to apply white ink, an ink image processing unit 5 for accelerating the drying of and otherwise processing the ink image, a transfer unit 6 for transferring the ink image formed on the transfer drum 1 to a recording medium 9, a recording medium separating unit 7 and a cleaning unit 8 for cleaning the surface of the transfer drum 1. There are further arranged a fed paper carrying unit 10 for carrying the recording medium 9 from a recording medium storage unit (fed paper cassette; not shown) to a nipping portion to be described afterwards, and a discharged paper carrying/fixing unit 11 having a fixing mechanism for fixing the ink image on the recording medium 9 after the ink image has been transferred from the transfer drum 1, which is the intermediate transfer body, to the recording medium 9, and discharging the recording medium 9 onto a discharged paper tray. The ink jet recording apparatus further has a control unit (not shown).

In this embodiment of the invention, the "recording medium" is not limited to ink jet recording paper and plain paper, which are generalized in conventional recording apparatus but may include a wide variety of ink-accepting materials such as paper, cloth, plastic sheets and the like. It can further be materials having little or no ink-absorbency, such as plastic sheets of PET or polyethylene or having a rough surface such as embossed paper.

The configurations of the members constituting the above-described embodiment will be described below in further detail.

Figure 2:
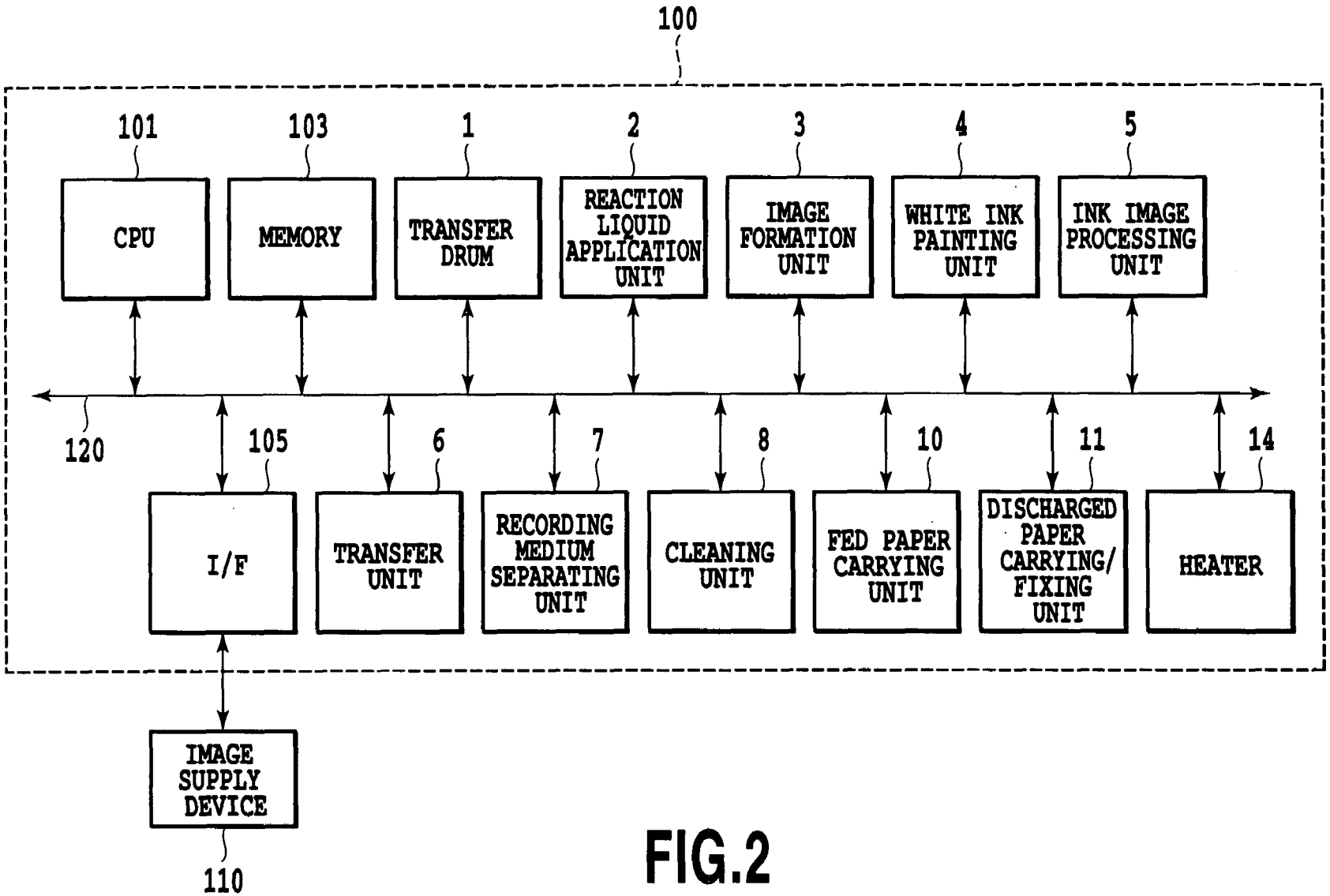
FIG. 2 is a schematic block diagram showing the configuration of a control unit in accordance with an embodiment of the invention.

FIG. 2 is a schematic block diagram showing the configuration of the control unit in the embodiment of the invention. Referring to FIG. 2, in the ink jet recording apparatus the whole of which is denoted by a reference numeral 100, a CPU 101 executes control processing, data processing and the like for the operation of this ink jet recording apparatus. A memory unit 103 has an ROM (not shown) in which programs of their processing procedures and the like are stored and an RAM (not shown) used as a work area or the like for their execution. An I/F 105 is an interface for exchanging information including data and commands between the ink jet recording apparatus and an image supply device 110, which is the supply source of image data, such as a host computer.

In addition to the foregoing, the transfer drum 1, reaction liquid application unit 2, image formation unit 3, white ink painting unit 4, ink image processing unit 5, transfer unit 6, recording medium separating unit 7, cleaning unit 8, fed paper carrying unit 10, discharged paper carrying/fixing unit 11 and a heater 14 are connected to a bus line 120. Therefore, the CPU 101 can exchange signals with various constituent parts via the bus line 120. Each of the constituent parts to be controlled is provided with a sensor for state detection, the detection signal from which can be communicated to the CPU 101 via the bus line 120.

Incidentally, unless image data supplied from the image supply device 110 are mirror-inverted data, the control unit performs inversion processing to generate mirror image data.

As shown in FIG. 1, in the transfer drum 1 which is an intermediate transfer body having a releasable surface layer, two layers of silicone rubber are formed as surface layers 13*a* and 13*b* around an aluminum-made support 12. The material of the support 12 is not necessarily limited to aluminum, but may as well be some other metal such as nickel or ferric phosphate, a strong thermosetting resin such as acetal, or a ceramic or the like, molded into an appropriate shape. Further, though the releasable surface layer illustrated in FIG. 1 consists of two layers of silicone rubber, this is not the only possible laminated structure, but the structure may be varied as appropriate with the elastic characteristic of the material.

Since the support of the transfer drum 1 is thus made of aluminum or the like, the rigidity against the pressure of transfer and dimensional accuracy can be enhanced. Furthermore, the responsiveness of control can be improved by reducing the inertia of rotation.

Also, the transfer drum 1 in this embodiment can be in any shape only if its surface layer 13*a* in a shape allowing at least line contact with the recording medium 9. The shape can be one of a drum as such, roller, belt, sheet or anything else if matched with the form of the applicable ink jet recording apparatus or the mode of transfer to the recording medium. Even if the surface layer 13*a* and the recording medium 9 are not in line contact with each other, a material highly susceptible to elastic deformation, such as a pad for use in pad printing, can also be used as the transfer drum 1 if matched with the shape of the recording medium.

The surface layer 13*a*, which constitutes the outermost surface of the transfer drum 1 having a releasable surface layer should preferably have a characteristic to permit ready peeling of the ink image off its surface (releasability). Since silicone rubber is low in surface energy and permits ready peeling off, it is one of the most suitable materials for the surface layer 13*a*. Whereas there are many types of silicone rubber including the vulcanized, single liquid-setting and double liquid-setting types, any of them can be suitably used. Other examples of material for the surface layer 13*a* include fluorosilicone rubber, phenyl silicone rubber, fluorine rubber, chloroprene rubber, nitrile rubber, ethylene propylene rubber, natural rubber, styrene rubber, isoprene rubber, butadiene rubber, ethylene/propylene/butadiene copolymer and nitrile butadiene rubber. Especially preferable ones include silicone rubber, fluorosilicone rubber, phenyl silicone rubber, fluorine rubber and chloroprene rubber. The surface layer 13*b*, which is positioned underneath the surface layer 13*a*, serves to optimize the elastic characteristic of the rubber layers constituting the surface of the support 12, and can be formed of an appropriate one of the materials listed above.

Further, it is more preferable to use an elastic member as the surface layer 13*a*, because it is adaptable to a wider variety of recording media. Suitable elastic members include surface-treated NBR and urethane rubber, and fluorine rubber and silicone rubber, both ink-repellent in themselves. It is desirable for the hardness of the rubber to be used for the surface layer 13*a* to be optimized relative to the thickness and hardness of the recording medium 9 to be brought into contact with the surface layer 13*a*, because these factors influence the performance. Rubber of 10 to 100° in hardness would prove effective, and a hardness range of 40 to 80° would provide adaptability almost any recording medium.

Although the surface layer 13*a* is supposed to be releasable in the description with reference to FIG. 1, there is no particular limitation regarding the surface layer 13*a* of the transfer drum 1. It is nevertheless desirable to consist of a releasable material and non-permeable (non-absorbent) from the viewpoint of improving the transfer rate. A releasable layer in this context means the difficulty for such fluid materials as ink and reaction liquid to adhere to its surface and the ease of subsequent peeling off. The higher the releasability, the more advantageous in respect of load during cleaning or the transfer rate of ink. On the other hand, however, the critical surface tension of the material decreases to make the surface liquid-repellent, i.e. difficult for ink or any other liquid to stick to, resulting in difficulty to hold the image. The releasable surface in the context of the present invention means a surface whose critical surface tension is not more than 30 mN/m or whose angle of contact with water is not less than 75°. In other words, the surface of the transfer drum 1 suitable for use according to the embodiment would consist of a material that, before undergoing surface treatment (hydrophilic treatment), repels any ink droplets that may impact the surface and thereby prevents any image from being formed (a material hardly capable of holding an ink image).

More specifically, a releasable surface layer can be obtained not only by using a releasable material of the kind described above for the surface layer 13*a*, but also be treating the surface of the surface layer 13*a* by, for instance, coating with Teflon (registered trademark) or applying silicone oil.

The heater 14 for ensuring the temperature stability of the transfer drum 1 is built into the transfer drum 1. Any suitable conventional means of heating, such as a halogen lamp, can be used as the heater 14. The set temperature of the heater preferably should be 20 to 100° C. with reference to the surface temperature of the transfer drum 1, more preferably be 25 to 80° C.

The reaction liquid application unit 2 shown in FIG. 1 comprises a reaction liquid container 15, reaction liquid 16, and applying rollers 17*a* and 17*b*. It applies the reaction liquid 16 within the reaction liquid container 15 to the transfer drum 1.

The reaction liquid application unit 2 is arranged upstream from the image formation unit 3, to be described afterwards, on the transfer drum 1. The applying roller 17*b* is enabled either to rotate following the transfer drum 1 (follower rotation) or under control by independent applying roller driving means (not shown). The applying roller 17*a* is enabled either to rotate following the applying roller 17*b* or under control by independent applying roller driving means. The rotation of the two applying rollers 17*a* and 17*b* in this way causes the reaction liquid 16 to be applied over the surface of the transfer drum 1. The thickness of the coat of the reaction liquid 16 over the transfer drum 1 should preferably set in a range of 0.1 to 10 μm, though the preferable thickness may vary with the concentration of the reaction liquid 16. If the coat of the reaction liquid is too thin, uneven application will make the reaction between the reaction liquid and the ink uneven. On the other hands, if the coat is too thick, coagulated ink will move over the surface of the reaction liquid and thereby invite beading. To ensure even application of the reaction liquid, the material of the applying rollers 17*a* and 17*b* should preferably be well wettable by the reaction liquid 16. A suitable surface profile for the applying rollers may be porous, uneven or like, a gravure roller, for instance.

The means of applying the reaction liquid need not be roller-shaped, but can as well use a method of controlling the applied quantity with a blade, one of applying and spreading it with a spray nozzle or a recording head over the whole or part of the image formation area of the transfer drum 1, or any other appropriate method. The reaction liquid application unit 2 is configured to be controllable as to coming into contact with or being moved away from the transfer drum 1 by a contact control device (not shown).

The reaction liquid for use in this embodiment of the invention will be described in detail below.

The reaction liquid in this embodiment is a material for reducing the fluidity of ink. For instance, a reaction liquid which coagulates coloring agents contained in the ink, for instance pigments or dyes, can be suitably used. In further detail, it is a liquid to perform the role of reducing the fluidity of ink on the transfer drum by contact with the ink and to keep the ink droplets having impacted the transfer drum in, or as close as possible to, their respective impacting positions (fixing the image). Fixing the image here refers not only to cases in which coloring agents, resins and the like which are part of the constituent elements of the ink chemically react or are physically adsorbed to reduce the overall fluidity of the ink but also cases in which coagulation of solid contents of the ink results in local reductions of fluidity.

Reaction liquids suitable for use in this embodiment include which those containing metallic salts. The most suitable among such metallic salts are polyvalent metallic salts. A polyvalent metallic salt consists of polyvalent metallic salt ions of divalence or a higher value and anions to couple with these polyvalent metallic ions. Specific examples of polyvalent metallic salt ions include divalent metallic ions such as $Ca^{2+}$, $Cu^{2+}$, $Ni^{2+}$, $Mg^{2+}$ and $Zn^{2+}$ and trivalent metallic ions such as $Fe^{3+}$ and $Al^{3+}$. Anions to couple with them include $Cl^-$, $NO_3^-$, $SO_4^-$, $I^-$, $Br^-$, $ClO_3^-$ and $RCOO^-$ (R is the alkyl group).

Water-soluble organic solvents usable as the reaction liquid for this embodiment include, for instance, amides such as dimethyl formaldehyde and dimethyl acetamide, ketones such as acetone, ethers such as tetrahydrofuran and dioxane, polyalkylene glycols such as polyethylene glycol and polypropylene glycol, alkylene glycols such as ethylene glycol, propylene glycol, butylene glycol, triethylene glycol, 1,2,6-hexane triol, thiodiglycol, hexylene glycol and diethylene glycol, lower alkyl ethers of polyvalent alcohols such as ethylene glycol methyl ether, diethyl glycol methyl ether, diethylene glycol monomethyl ether and triethylene glycol monomethyl ether and monovalent alcohols such as ethanol, isopropyl alcohol, n-butyl alcohol and isobutyl alcohol. They further include glycerin, N-methyl-2-pyrrolidone, 1,3-dimethyl-imidazolydinone, triethanolamine, sulfolane and dimethyl sulfoxide. There is no restriction regarding the content of any of the water-soluble organic solvents in the reaction liquid for use in this embodiment, but its preferable range is 5 to 60 wt % of the total weight of the reaction liquid, more preferably from 5 to 40 wt %.

The reaction liquid for use in this embodiment may further contain as a coagulation aid a water-soluble resin such as polyamine or polyamine derivatives, water-soluble cross-linking agent, acid solution or the like. Any such coagulation aid, because of their relatively high molecular weight, takes time to react. For their reason, its combined use with a polyvalent metal salt can contribute to increasing the internal coagulating force of the coagulated ink image that is formed. As a result, the efficiency of transferring the coagulated ink image on the transfer drum 1 to the recording medium 9 can be enhanced.

Further, a surfactant can be used as an application aid to ensure uniform application of the reaction liquid 16 onto the transfer drum 1. The surfactants that can be used include, for instance, Surflon S-141 (commercial name; a product of Seimi Chemical Co., Ltd.), Silhouette L-77 (commercial name; a product of Nippon Unicar Co., Ltd.) and Acetylenol EH (commercial name; a product of Kawaken Fine Chemicals Co., Ltd.). Surfactants usable for this embodiment are not limited to these, but include various other surfactants such as fluorine-based surfactants, silicone-based surfactants, water-soluble anionic surfactants, cationic surfactants, nonionic surfactants and amphotertic surfactants. The quantity of any such surfactant to be added should preferably be 0.05 to 10 mass % of the reaction liquid 16, more preferably 0.1 to 5 mass %.

In addition, additives such as a viscosity adjuster, pH adjuster, preservative and/or antioxidant may be blended in appropriate proportions with the reaction liquid 16 for use in this embodiment as required. The reaction liquid 16 for use in this embodiment should preferably colorless, but a color light enough not to alter the hue of any color ink when blended with it on the recording medium would be acceptable. The reaction liquid 16 comprising the materials mentioned above should preferably be so adjusted in physical properties that its viscosity at or around 25° C. be within a range of 1 to 30 cps. (mPa·S).

In this embodiment, a hydrophilic treating step (not shown in FIG. 1) to be described afterwards may be provided to perform hydrophilic treatment to increase the wettability (surface energy) of the surface layer 13*a* of the transfer drum 1 before applying the reaction liquid. Such hydrophilic treatment would make the reaction liquid less likely to be repelled by the intermediate transfer body.

Referring to FIG. 1, the image formation unit 3 forms an ink image by applying with a recording head ink containing at least coloring agents to the transfer drum 1 coated with the reaction liquid 16 described above according to image signals supplied from a control unit.

The ink image formed in this way is converted into a coagulated ink image by the reaction between the ink applied by the image formation unit 3 and the reaction liquid 16 on the transfer drum 1. Therefore, even where a color image is formed of inks or different concentrations or a plurality of color inks on the transfer drum 1, the image can be restrained in beading and bleeding. There is provided a further advantage that, even after this coagulated ink image is transferred onto the recording medium 9, a color image of high picture quality can be formed. The "coagulated ink image" in the context of this specification means an ink image formed of ink droplets reduced in fluidity and held in their respective impacting positions.

Referring to FIG. 1, the image formation unit 3 is arranged downstream from the reaction liquid application unit 2 of the transfer drum 1, and comprises recording heads 18*a*, 18*b*, 18*c* and 18*d*. In the description of this embodiment, the recording heads 18*a*, 18*b*, 18*c* and 18*d* will be collectively referred to as recording heads 18. The ink jet recording apparatus in this mode of implementing the invention uses line type ink jet recording heads of a type using heating elements (heaters), which are electrothermal conversion elements, as the recording heads 18. The recording heads 18*a*, 18*b*, 18*c* and 18*d* are arranged in the circumferential direction of the transfer drum 1 at regular intervals. Although the configuration shown in FIG. 1 uses line type ink jet recording heads, it is obviously possible to use a recording head whose plurality of nozzle arrays, differentiated by ink color, are arranged within a prescribed range in the circumferential direction or axial direction (the direction perpendicular to the paper surface of FIG. 1) of the transfer drum 1 (hereinafter also referred to as "serial type recording head" in this specification). In this case, image formation on the transfer drum 1 may be accomplished sequentially while scanning with the serial type recording head in the axial direction. Where the serial head is used, the rotation of the transfer drum will be driven stepwise, by a degree matched with the length of the nozzle array of the head. Furthermore, the aforementioned type using heating elements is not the only available type of ink jet recording heads, but means of any type, such as a piezoelectric element-driven type, that can eject ink from nozzles can be used.

Each of the four recording heads 18 referred to above is composed to apply ink of a different color from others. In the configuration shown in FIG. 1, the recording heads 18*a*, 18*b*, 18*c* and 18*d* are respectively supposed to apply inks of yellow (Y), magenta (M), cyan (C) and black (K). The recording heads 18 consisting of them are supplied with inks of the respective colors from ink tanks (not shown). The heating element for each recording head emits heat according to an image signal received from the control unit correspondingly to each color, and generates bubbles by raising the temperature of the ink supplied from the corresponding ink tank. Expansion of the generated bubbles causes ink droplets to be ejected from the plurality of nozzles of each of the recording heads 18. Incidentally, the number of ink jet recording heads constituting the image formation unit in this mode of implementing the invention, the sequence of colors of the inks ejected onto the transfer drum 1 and the hues of inks used are not limited to the above-described.

To add, the ink image to be formed on the transfer drum 1 is required to be a mirror image of the image to be ultimately formed on the recording medium 9 in view of the inversion that takes place when the image is transferred. The image signals to be supplied to the recording heads 18 are supposed to be image signals matching the mirror image. To meet this requirement, the control unit subjects the image signals supplied from the image supply device 110 (i.e. image signals matching the image to be ultimately formed on the recording medium 9) to mirror inversion processing (processing to obtain inverted data), thereby acquires image signals matching the mirror image, and supplies them to the recording head.

This embodiment of the invention can use any of the conventional inks for ink jet use. In particular, pigment inks containing at least pigments as coloring agents are suitable, because they would give steady recorded images. Pigment inks that are suitable for use in this embodiment will be described below.

The proportion of each pigment in pigment ink should preferably be 1 to 20 mass % of the total mass of the pigment ink, more preferably 2 to 12 mass %. Specific examples of the pigments to be used in this embodiment include the following.

The suitable black pigment is carbon black. For instance, a particularly suitable type is carbon black manufactured by the furnace method or the channel method of which the primary grain size is 15 to 40 mμ (nm), the specific surface area by the BET method is 50 to 300 $m^2/g$, the DBP oil absorption is 40 to 150 ml/100 g, the volatile content is 0.5 to 10% and the pH count is 2 to 9. Commercially available products having such characteristics include, for instance, No. 2300, No. 900, MCF88, No. 33, No. 40, No. 45, No. 52, MA7, MA8 and No. 2200B (so far products of Mitsubishi Chemical Industries, Ltd.), RAVEN 1255 (a Colombian product), REGAL 400R, REGAL 330R, REGAL 660R and MOGUL L (so far products of Cabot), Color Black FW1, Color Black FW 18, Color Black S170, Color Black S150, Printex 35 and Printex U (so far products of Degussa), all preferable for use.

Suitable yellow pigments include, for instance, C.I. Pigment Yellow 1, C.I. Pigment Yellow 2, C.I. Pigment Yellow 3, C.I. Pigment Yellow 13, C.I. Pigment Yellow 16 and C.I. Pigment Yellow 83. Usable magenta pigments include, for instance, C.I. Pigment Red 5, C.I. Pigment Red 7, C.I. Pigment Red 12, C.I. Pigment Red 48 (Ca), C.I. Pigment Red 4 8 (Mn), C.I. Pigment Red 57 (Ca), C.I. Pigment Red 112 and C.I. Pigment Red 122. Applicable cyan pigments include, for instance, C.I. Pigment Blue 1, C.I. Pigment Blue 2, C.I. Pigment Blue 3, C.I. Pigment Blue 15:3, C.I. Pigment Blue 16, C.I. Pigment Blue 22, C.I. Vat Blue 4 and C.I. Vat Blue 6. Obviously the pigments that can be used in this embodiment are not limited to these. In addition to the above, newly manufactured pigments including self-dispersing type pigments can also be used of course.

As regards dispersants to be used in producing water-based pigment ink to disperse the pigment in the water-based medium, any water-soluble resin can be used. Preferable dispersants include, for instance, those whose weight-averaged molecular weight is 1,000 to 30,000, more preferably 3,000 to 15,000. More specifically, such dispersants include, for instance, the block copolymer, random copolymer or graft copolymer of two or more monomers (of which at least one is a hydrophilic polymeric monomer) selected out of styrene, styrene derivatives, vinyl naphthalene, vinyl naphthalene derivatives, aliphatic alcohol esters of $\alpha$, $\beta$-ethylene unsaturated carboxylic acid, acrylic acid, acrylic acid derivatives, maleic acid, maleic acid derivatives, itaconic acid, itaconic acid derivatives, fumaric acid, fumaric acid derivatives, vinyl acetate, vinyl pyrrolidone, acryl amide and its derivatives, or their salts. Natural resins including rosin, shellac and starch can also be used suitably. These resins are soluble in aqueous solution of base, and are alkali-soluble resins. Incidentally, the proportion of any of these water-soluble resins to be used as pigment dispersants should preferably by kept within a range of 0.1 to 5 mass % of the total mass of pigment ink.

Especially for pigment ink containing any of the pigments mentioned above, it is preferable for the pigment ink as a whole to be kept neutral or alkaline. Such adjustment would enhance the solubility of the water-soluble resin used as the pigment dispersant and accordingly the preservability of the pigment ink. However, since this might sometimes invite corrosion of various members used in the ink jet recording apparatus, the pH range should preferably be kept between 7 and 10. The pH adjusters usable for this purpose include, for instance, organic amines including diethanolamine and triethanol amine, inorganic alkalis including the hydroxides of alkaline metals such as sodium hydroxide, lithium hydroxide and potassium hydroxide, organic acids and mineral acids. Coloring agents, including the aforementioned pigments, and water-soluble resins, which are dispersants, are dissolved or dispersed in an aqueous liquid medium to constitute pigment ink for use in this invention.

Aqueous liquid media suitable for use in this embodiment to constitute pigment ink are mixed solvent of water and water-soluble organic solvent. The water should preferably be ion-exchanged water (de-ionized water) instead of ordinary water containing various ions.

Water-soluble organic solvents to be used in mixture with water include, for instance, alkyl alcohols of 1 to 4 in carbon number such as methyl alcohol, ethyl alcohol, n-propyl alcohol, isopropyl alcohol, n-butyl alcohol, sec-butyl alcohol and tert-butyl alcohol; amides such as dimethyl formamide and dimethyl acetamide; ketones or keto alcohols such as acetone and diacetone alcohol; ethers such as tetrahydrofuran and dioxane; polyalkylene glycols such as polyethylene glycol and polypropylene glycol; alkylene glycols whose alkylene group contains 2 to 6 carbon atoms such as ethylene glycol, propylene glycol, butylene glycol, triethylene glycol, 1,2,6-hexane triol, thiodiglycol, hexylene glycol and diethylene glycol; glycerin; lower alkyl ethers of polyvalent alcohols such as ethylene glycol monomethyl (or ethyl) ether, diethylene glycol methyl (or ethyl) ether and triethylene glycol monomethyl (or ethyl) ether; and N-methyl-2-pyrrolidone, 2-pyrrolidone and 1,3-dimethyl-2-imidazolidinone. Out of these diverse water-soluble organic solvents, polyvalent alcohols including diethylene glycol, and lower alkyl ethers of polyvalent alcohol including triethylene glycol monomethyl (or ethyl) ether are more preferable.

Generally, the proportion of any of these water-soluble organic solvents in pigment ink is required to be 3 to 50 mass % of the total mass of the pigment ink, more preferably 3 to 40 mass %. That of water to be used is required to be 10 to 90 mass %, of the total mass of the pigment ink, more preferably 30 to 80 mass %.

Also, besides the ingredients stated above, a surfactant, antifoaming agent, preservative and so forth can be added in appropriate quantities as required to the pigment ink for use in this embodiment to provide the pigment ink with desired physical properties. Especially, a surfactant to function as a permeation accelerator should be added in an appropriate quantity to enable it to ensure fast permeation of the reaction liquid and the liquid components of the pigment ink into the recording medium. A typical proportion of the quantity would be 0.05 to 10 mass %, more preferably 0.5 to 5 mass %. Preferable anionic surfactants include, for instance, carboxylate type, sulfate type, sulfonate type and phosphate type agents, all in common use.

Pigment ink consisting of the above-described materials is prepared by the following method. First a pigment is added to an aqueous medium containing at least a water-soluble resin as the dispersant and water. Then, after mixing and stirring, dispersion is accomplished by using dispersing means to be described afterwards, and centrifugal separation is performed as required to obtain a desired dispersed solution. To this solution, a sizing agent and additive components appropriately selected from the foregoing are added, and the mixture is stirred to obtain pigment ink for use in this invention.

When any of the aforementioned alkali-soluble resins is to be used as the dispersant, it is necessary to add base to dissolve the resin. Such bases for preferable use include organic amines such as monoethanol amine, diethanol amine, triethanol amine, amine methyl propanol and ammonia, and inorganic bases such as potassium hydroxide and sodium hydroxide.

In the method of preparing pigment ink, it is more effective to stir an aqueous medium containing pigment, and premix it for 30 minutes or longer before the dispersion processing. This premixing is preferable because it would increase the wettability of the pigment surface and thereby to facilitate adsorption of the dispersant to the pigment surface.

Any dispersing machine for common use can be used for the dispersion processing of the pigment, such as a ball mill, roll mill or sand mill for instance. A high-speed sand mill would be preferable. It is available indifferent versions including, for instance, Supermill, Sand Grinder, Beads Mill, Agitator Mill, Grain Mill, Daino Mill, Pearl Mill and Cobol Mill (all commercial names).

A pigment for use by an ink jet recording method using pigment ink should have the optimal grain distribution to reduce clogging and other troubles. A pigment having a desired grain distribution can be obtained by reducing the size of the crushing medium of the dispersing machine, increasing the filling rate of the crushing medium, extending the duration of processing, slowing the delivery speed, classifying the crushed pigment with a filter or a centrifuge, and a combination of some of these means.

Although the foregoing description referred to pigment ink using a pigment as its coloring agent, this embodiment is not limited in the choice of ink to such ink, but can use dye ink or any known conventional dye is added to it besides pigment to alter the hue. Or if the reaction liquid contains a metallic salt, a water-soluble resin or cross-linking agent can be added to the ink and/or the reaction liquid to strengthen the internal coagulating force of the coagulated ink image.

Referring to FIG. 1, the white ink painting unit 4 comprises a recording head 19 for applying white ink and an ink tank (not shown) storing the white ink to be supplied to this recording head 19. The white ink painting unit 4 applies white ink with the white ink applying recording head 19 to match a coagulated ink image 20 formed by the image formation unit 3.

In this process, the control unit creates data to be delivered to the white ink painting unit 4 (white ink data) according to the data from which an image is to be formed (image data). Thus, the control unit creates white ink data by calculating the logical sum of data matching the colors (YMCK) delivered to the recording heads 18 (color ink data). The white ink painting unit 4 is thereby enabled to superpose with the white ink applying recording head 19 white ink dots on the each dots of the color inks constituting the coagulated ink image 20. The areas of white ink formed on the transfer drum 1 in this way can increase the concealability only of the image part (color ink-applied part). Further, the color and pattern of the recording medium can be utilized in the image transferred at the subsequent transferring step.

To add, the white ink data may be so created as to overlap in a prescribed ratio for the boundaries of the image part of the data representing the logical sum. For instance, N dot(s) (e.g. one dot) of white ink data can be applied in a position spilling out of the boundaries of the image part of the data representing the logical sum. In this way, the undercoating of the image parts can be made closer to perfection.

Although the white ink data are created according to image data in this embodiment, they need not be so created. For instance, white ink data may as well be so created as to form a prescribed white background, such as in a square or circulate shape, in the image part by applying white ink in a prescribed ratio from the boundaries of the image part of the color ink data representing the logical sum. This would prove effective where the image part requires a prescribed background, such as in a square or circulate shape.

The white ink data may as well be created by thinning out in a prescribed ratio the color ink data representing the logical sum. Such thinning-out processing would prove effective where it is desired to restrain the quantity of white ink applied, such as where the color of the recording medium 9 is closed to white.

Further, where it is desired to highlight the image on a colored recording medium by undercoating the recording medium in white, it would be effective to apply white ink not only to the image part but also the spilled-out portion around the image part.

As described above, in this embodiment of the invention, it is made possible to increase the concealability of the area of the recording medium to which the coagulated ink image 20 is transferred by so setting the area of white ink dots to be formed on the transfer drum 1 as to cover at least the area to which color ink dots are applied. Also, the color reproducibility of the transferred image can be made satisfactory, made less susceptible to the influences of the color and pattern of the recording medium. Thus, since white ink is loaded at least on the area where color ink dots are applied, the area where white ink is applied functions as if a white undercoat of the coagulated ink image 20 and conceals the color and pattern of the recording medium after the subsequent transfer step. As the inks applied to the image formation unit 3 then are coagulated by reaction with the reaction liquid 16, mixing of those inks and the subsequently applied white ink is reduced.

It hardly needs to mention that the white ink data created as described above are mirror image data. The white ink data may be either two-value data or multi-value data. The changeover of the form of creating white ink data for such a prescribed area may be accomplished from an input unit (not shown), such as a touch panel, provided on the ink jet recording apparatus or by command data from the image supply device 110.

Referring to FIG. 1, the white ink painting unit 4 is disposed downstream from the image formation unit 3 on the transfer drum 1. In this embodiment, the white ink applying recording head 19 uses line type ink jet recording heads of a form using heating elements. The white ink applying recording head 19 is arranged on the downstream side in the circumferential direction of the transfer drum 1 in parallel to the recording heads 18*a*, 18*b*, 18*c* and 18*d* of the image formation unit 3, and applies white ink onto the transfer drum 1 according to white ink data. Although FIG. 1 shows a configuration in which a line type ink jet recording head is used as the white ink applying recording head, of course a conventional serial type recording head can be used as well. In that case, white ink is sequentially applied onto the coagulated ink image 20 formed on the transfer drum 1 while scanning with the serial type recording head in the axial direction. Further, the type of the white ink applying recording head is not limited to the aforementioned, but any other type that can discharge ink can be used, such as a piezoelectric element-driven type.

The white ink for use in this embodiment will be described below.

The white ink serves not only to conceal the color or pattern of the undercoat of the coagulated ink image 20 (namely the recording medium) but also to make the coloring agents look more vivid. In this embodiment, the white ink mainly consists of an ordinary ink deprived of the otherwise used pigment or dye, which is a coloring agent, and augmented with a white ink component.

The white ink for use in this embodiment contains a white pigment. The use of the white pigment makes it possible to form a vivid color image, unaffected by the color or pattern of the undercoat of the recording medium. The white pigments usable for this purpose include white inorganic pigments consisting of the oxide, sulfate or carbonate of zinc, lead, barium, titanium or antimony, and white organic pigments including ethylene-bis-melamine (Shigenox OWP in commercial product name; a product of Hakko Chemical Kabushiki Kaisha). The grain size of any of these white pigments should not be greater than 10 μm and the proportion of its quantity, 1 to 30 mass % of the total volume of the white ink.

To the white ink for use in this embodiment, a surfactant, antifoaming agent, preservative and the like can be added in appropriate quantities besides the aforementioned components as required to provide the white ink with desired physical properties. In particular, an appropriate quantity of a surfactant has to be added to adjust the surface tension for ensuring steady ejecting of the white ink from the white ink applying recording head 19. The appropriate quantity to be added may be, for instance, 0.05 to 10 mass %, more preferably 0.5 to 5 mass %. Preferable anionic surfactants include, for instance, carboxylate salts, sulfate esters, sulfonate salts and phosphate esters, all in common use.

Further, a water-soluble resin can be added to enhance the coagulatability of transferred white ink. While any water-soluble resin can be used, preferable resins include, for instance, those whose weight-averaged molecular weight is 1,000 to 30,000, more preferably 3,000 to 15,000. More specifically, such dispersants include, for instance, the block copolymer, random copolymer or graft copolymer of two or more monomers (of which at least one is a hydrophilic polymeric monomer) selected from styrene, styrene derivatives, vinyl naphthalene, vinyl naphthalene derivatives, aliphatic alcohol esters of α, β-ethylene unsaturated carboxylic acid, acrylic acid, acrylic acid derivatives, maleic acid, maleic acid derivatives, itaconic acid, itaconic acid derivatives, fumaric acid, fumaric acid derivatives, vinyl acetate, vinyl pyrrolidone, acryl amide and its derivatives, or their salts. Natural resins including rosin, shellac and starch can also be used suitably. These resins are soluble in aqueous solution of base, and are alkali-soluble resins. Incidentally, the proportion of any of these water-soluble resins should preferably by kept within a range of 0.1 to 5 mass % of the total mass of white ink.

The pH adjusters usable for adjusting the solubility of resins include, for instance, organic amines including diethanol amine and triethanol amine, inorganic alkalis including the hydroxides of alkaline metals such as sodium hydroxide, lithium hydroxide and potassium hydroxide, organic acids and mineral acids. Such water-soluble resins are dispersed or dissolved in an aqueous liquid medium to constitute white ink for use in this invention.

Aqueous liquid media suitable for use in this embodiment to constitute white ink are mixed media of water and water-soluble organic solvent. The water should preferably be ion-exchanged water (de-ionized water) instead of ordinary water containing various ions.

Water-soluble organic solvents to be used in mixture with water include, for instance, alkyl alcohols of 1 to 4 in carbon number such as methyl alcohol, ethyl alcohol, n-propyl alcohol, isopropyl alcohol, n-butyl alcohol, sec-butyl alcohol and tert-butyl alcohol; amides such as dimethyl formamide and dimethyl acetamide; ketones or keto alcohols such as acetone and diacetone alcohol; ethers such as tetrahydrofuran and dioxane; polyalkylene glycols such as polyethylene glycol and polypropylene glycol; alkylene glycols whose alkylene group contains 2 to 6 carbon atoms such as ethylene glycol, propylene glycol, butylene glycol, triethylene glycol, 1,2,6-hexane triol, thiodiglycol, hexylene glycol and diethylene glycol; glycerin; lower alkyl ethers of polyvalent alcohols such as ethylene glycol monomethyl (or ethyl) ether, diethylene glycol methyl (or ethyl) ether and triethylene glycol monomethyl (or ethyl) ether; and N-methyl-2-pyrrolidone, 2-pyrrolidone and 1,3-dimethyl-2-imidazolidinone. Out of these diverse water-soluble organic solvents, polyvalent alcohols including diethylene glycol, and lower alkyl ethers of polyvalent alcohol including triethylene glycol monomethyl (or ethyl) ether are more preferable.

Generally, the proportion of any of these water-soluble organic solvents in white ink is required to be 3 to 50 mass % of the total mass of the white ink, more preferably 3 to 40 mass %. That of water to be used is required to be 10 to 90 mass %, of the total mass of the white ink, more preferably 30 to 80 mass %.

The white of white ink here refers to what satisfies the conditions that, where white ink alone is applied to a recording medium, its surface has a luminosity index L* is not less than 80 as measured by a method stated in JIS Z8722 or JIS Z8729, and $-10 \leqq a^* \leqq 10$, $-10 \leqq b^* \leqq 10$.

Referring to FIG. 1, the ink image processing unit 5 comprises an air knife 22 and a solvent receptacle saucer 23. In the ink image processing unit 5, the coagulated ink image 20 is so processed that, when the coagulated ink image 20 formed by the image formation unit 3 is to be transferred to the recording medium 9, it can be transferred under conditions as close as practicable to the optimum.

Referring to FIG. 1, the ink image processing unit 5 is provided downstream from the white ink painting unit 4. The white ink image processing unit 5 is equipped with the air knife 22 and the solvent receptacle saucer 23. The air knife 22 supplies a warm air flow heated by a heater (not shown) to evaporate or separate the liquid medium contained in the ink, mainly moisture in the ink, and remove it. Thus the ink image processing unit 5 is provided for the purpose of controlling the characteristics of the transfer of the coagulated ink image 20 to the recording medium 9, with differences in the permeability of the coagulated ink image 20 into the recording medium 9 being taken into account, by adjusting the quantity of air blown from the air knife or the calorific value pertaining to the temperature of that air.

Incidentally, though this embodiment uses the air knife 22 as means of drying the coagulated ink image 20, any known technique by which the temperature and the characteristics of the ink image can be controlled, such as an infrared heater, can be used for this purpose.

Referring to FIG. 1, the transfer unit 6 comprises a transfer roller 26, and the fed paper carrying unit 10 comprises carriage rollers 24*a* and 24*b*, and carriage guides 25*a* and 25*b*.

In the transfer unit 6, the ink image 20 on the transfer drum 1 is pressure-transferred by the transfer roller 26 to the recording medium 9 carried by the carriage rollers 24*a* and 24*b* and the carriage guides 25*a* and 25*b* of the fed paper carrying unit 10.

The transfer roller 26, so arranged as to cause the recording medium 9 to pass the nipping portion with the transfer drum 1, can be formed of a rubber roller, metallic roller or the like. This transfer unit 6 can perform control to release the transfer drum 1 from pressure with a pressure control device (not shown). In the drawing, the carriage rollers 24*a* and 24*b* turn in the direction of arrow B, and the transfer roller 26, in the direction of arrow C. The transfer roller 26, when in a pressed state, is enabled either to rotate following the transfer drum 1 (follower rotation) via the recording medium 9 or under control by independent transfer roller driving means (not shown). FIG. 1 shows the transfer roller 26 in follower rotation. Although the transfer roller 26 is so configured as to press the transfer drum 1 via the recording medium 9 with a line load of 0.6 kg/cm when being engaged in a transfer, but this is not the only possible pressing condition.

Referring to FIG. 1, the recording medium separating unit 7 comprises a separating claw 27. In the recording medium separating unit 7, the separating claw 27 operates according to the timing of carrying the recording medium 9.

The separating claw 27, upon completion of the transfer, drives with a driving device (not shown) to separate the recording medium 9 away from the transfer drum 1, and guides the recording medium 9 to the discharged paper carrying/fixing unit 11 with carriage guides 28*a* and 28*b*.

Referring to FIG. 1, the discharged paper carrying/fixing unit 11 comprises the carriage guides 28*a* and 28*b* and carriage/fixation rollers 29*a* and 29*b*.

In the discharged paper carrying/fixing unit 11, the carriage/fixation rollers 29*a* and 29*b* having infrared heaters thermally fix the ink image, transferred to the recording medium 9 under guidance by the carriage guides 28*a* and 28*b*, discharge it to a discharged paper tray (not shown) along with the rotation of these rollers, and thereby complete recording. Any conventionally known fixation rollers can be used as the carriage/fixation rollers 29*a* and 29*b*. The preferable temperature range for the fixation rollers is 30 to 200° C. approximately. The roller may be formed of a metal, silicone rubber or any other appropriate material. The roller surface may be coated with silicone oil or the like for easier release.

Referring to FIG. 1, the cleaning unit 8 comprises cleaning liquid 30, a cleaning liquid holding member 31 for holding the cleaning liquid 30, a cleaning liquid feed roller 32*a* and a cleaning roller 32*b*, the last two for applying the cleaning liquid 30 and removing dust and the like sticking to the transfer drum 1.

In the drawing, the cleaning roller 32*b* is enabled to rotate either following the transfer drum 1 (follower rotation) or under control by driving means (not shown). The cleaning liquid feed roller 32*a* is enabled to rotate either following the cleaning roller 32*b* or under control by driving means (not shown). As described so far, the turning of the cleaning liquid feed roller 32*a* and the cleaning roller 32*b* causes the cleaning liquid 30 to be applied to the transfer drum. In this way, the cleaning unit 8 cleans the transfer drum 1.

The cleaning unit 8 is subject to no particular limitation as to its hardware configuration or the choice of the cleaning liquid 30 if only it can clean the surface of the transfer drum 1. For instance, it is preferable to use an aqueous solution containing a surfactant, water-soluble organic solvent or the like, like what is used in the reaction liquid 16, as the cleaning liquid 30.

The operational sequence of the ink jet recording apparatus embodying the invention in the configuration described above will now be described in detail with reference to FIG. 1.

When power supply to the ink jet recording apparatus is turned on, driven rotation of the transfer drum 1 starts, respective heaters for the inside of the transfer drum 1, the air knife 22 and the carriage/fixation rollers 29*a* and 29*b* are turned on, and the heated components rise in temperature to their respective set points. Upon receiving image data from the image supply device 110, consisting of a computer or the like, the applying roller 17*b* constituting the reaction liquid application unit 2 comes into contact with the transfer drum 1. Then, the rotation of the applying roller 17*a* causes the reaction liquid 16 to be applied to the applying roller 17*b* via the applying roller 17*a*, and the reaction liquid 16 is uniformly applied onto the transfer drum 1. After one turn of the transfer drum 1 to cause the reaction liquid 16 to be applied onto the transfer drum 1, the applying roller 17*b* moves away from the transfer drum 1. Of course, an ink image can be formed by the image formation unit 3 in the area of the transfer drum 1 where the reaction liquid 16 has been applied while applying the reaction liquid 16 onto the transfer drum 1.

Since multi-value image data (hereinafter sometimes referred to as "external image data" in this specification) matching the ink colors (CMYK) used in this embodiment are supplied here from the image supply device 110, the control unit converts these multi-value image data to two-value image data matching YMCK. Then the control unit subjects the two-value image data matching the colors to mirror inversion processing to acquire two-value inverted image data matching the colors. The control unit creates white ink data matching the two-value inverted image data. The white ink data here are data obtained by calculating the logical sum of the various color image data.

Then, the two-value inverted image data matching the colors are delivered to the recording heads 18. Along with the rotation of the transfer drum 1, inks of different colors are sequentially ejected from the recording heads 18*a*, 18*b*, 18*c*, and 18*d* matching those image data and applied to the transfer drum 1. Reaction of the applied inks with the reaction liquid 16 applied to the transfer drum 1 causes a coagulated ink image 20 to be formed on the transfer drum 1 in color. This coagulated ink image 20 of course is the mirror image of the final image to be formed on the recording medium 9.

Then, the white ink data are delivered to the white ink applying recording head 19. Next, along with the rotation of the transfer drum, white ink is ejected from the white ink applying recording head 19 and applied to the coagulated ink image 20 on the transfer drum 1. The coagulated ink image 20 to which the white ink has been applied is deprived of the solvent by evaporation in the ink image processing unit 5 to be optimized for the subsequent transfer.

To the transfer unit 6, the recording medium 9 is so carried by the carriage rollers 24*a* and 24*b* that the recording medium 9, which is the transfer recipient, overlap the leading position of the ink image formed on the transfer drum 1 as described above at the nipping portion, which is the destination of transfer. In the transfer unit 6, when the arrival of the tip of the recording medium 9 at the nipping portion between the transfer drum 1 and the transfer roller 26 is detected by a sensor (not shown), the transfer roller 26 is driven to be pressed against the transfer drum 1 via the recording medium 9. Then a prescribed transfer pressure is generated by a pressure control device to transfer the coagulated ink image 20, to which white ink has been applied, on the transfer drum 1 to the recording medium 9.

Then, the ejection of the tip of the recording medium 9 out of the transfer unit 6 is detected by a sensor (not shown). At the same time, the separating claw 27 is driven to be inserted between the transfer drum 1 and the recording medium 9 to separate the recording medium 9 from the transfer drum 1. The recording medium 9 separated from the transfer drum 1, after thermal pressure is applied onto the recording medium 9 by the carriage guides 28*a* and 28*b* and the carriage/fixation rollers 29*a* and 29*b* to process fixation, is discharged into the discharged paper tray. After the whole ink on the transfer drum 1 is transferred to the recording medium 9, the transfer roller 26 and the separating claw 27 are separated from each other.

Next, the cleaning roller 32*b* comes into contact with the transfer drum 1 and cleans the surface of the transfer drum 1 by applying the cleaning liquid 30. When the transfer drum has completed a full turn, the cleaning roller 32*b* moves away from the transfer drum 1. When recording is continued, the above-described operation is repeated according to external image data. When recording is completed and power supply is to be turned off, after turning off every heater and stopping the rotation of the transfer drum 1, the power supply to the ink jet recording apparatus is turned off to end the operation of the apparatus.

This embodiment of the invention has been described with reference to the ink jet recording apparatus having a configuration in which, as shown in FIG. 1, the white ink painting unit 4 is arranged between the image formation unit 3 and the ink image processing unit 5. However, the configuration is not limited to this, but any configuration in which the white ink painting unit 4 is arranged between the reaction liquid application unit 2 and the transfer unit 6 as shown in FIG. 3 and FIG. 4, for instance, can serve the purpose.

Figure 3:
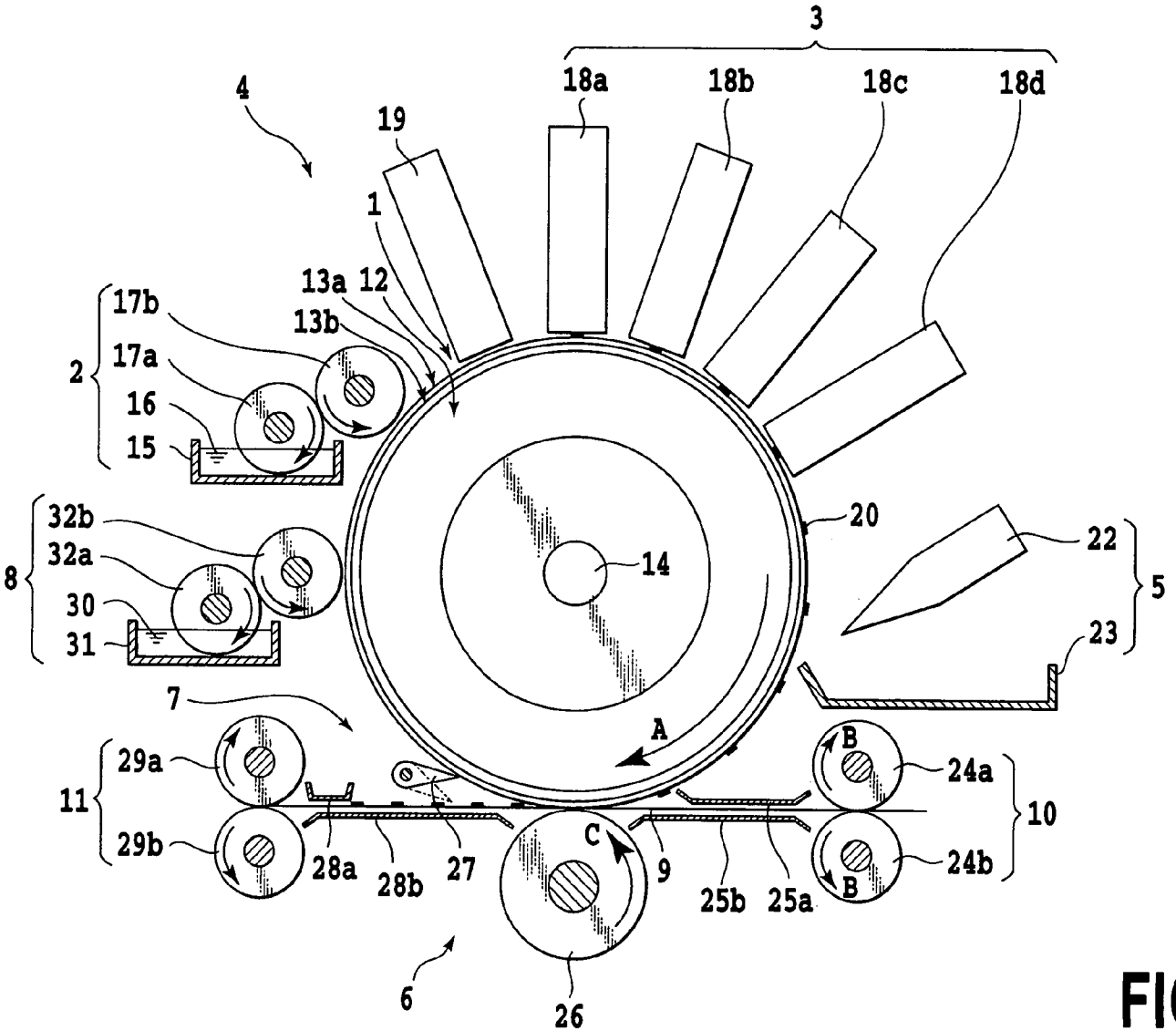
FIG. 3 is a schematic diagram showing the configuration of an image format ion unit of the ink jet recording apparatus, which is an embodiment of the invention.
Figure 4:
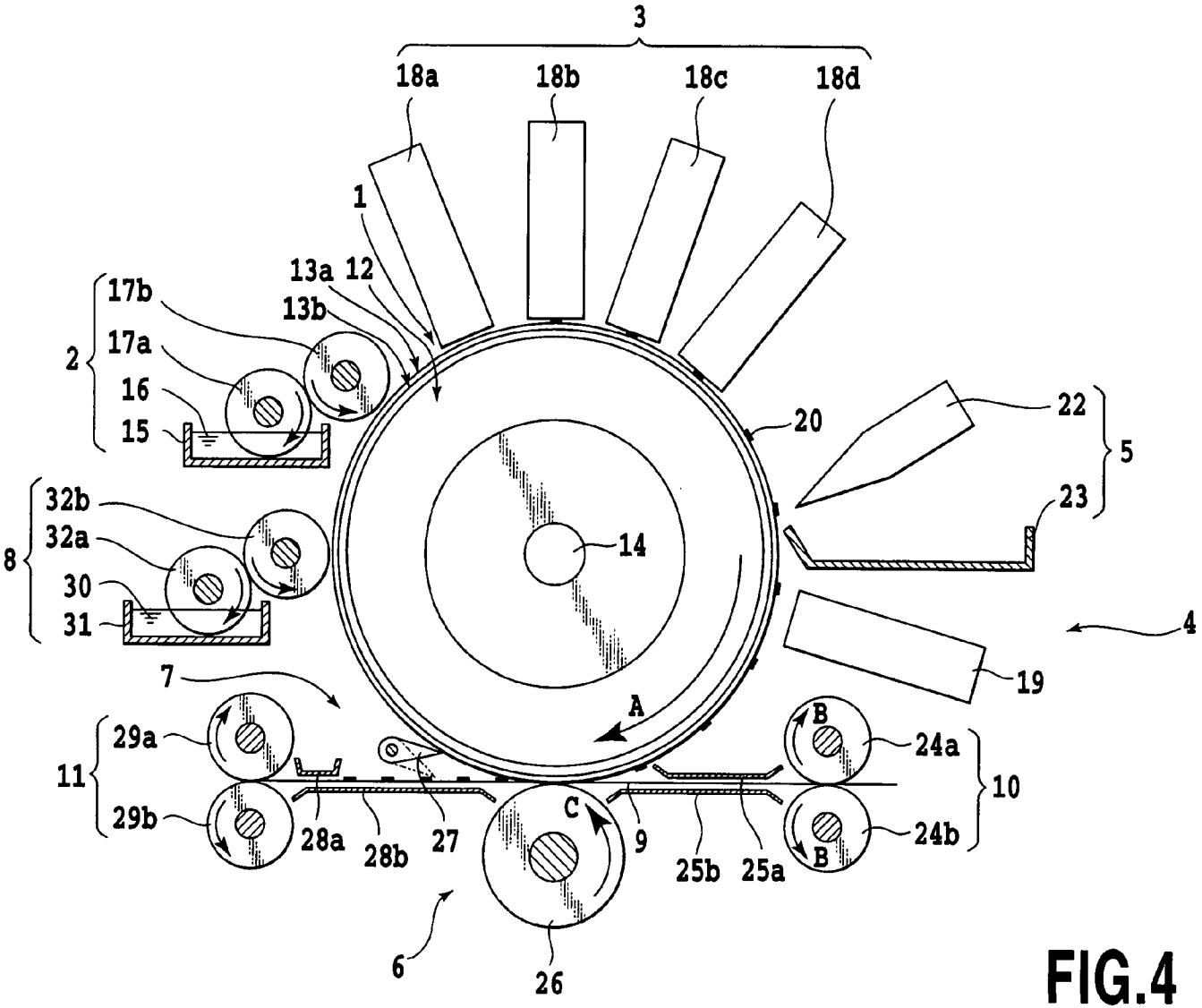
FIG. 4 is a schematic diagram showing another configuration of the image formation unit of the ink jet recording apparatus, in accordance with an embodiment of the invention.

FIG. 3 and FIG. 4 are schematic diagrams showing the configuration of the image formation unit of the ink jet recording apparatus embodying the invention in this mode. FIG. 3 shows a configuration in which the white ink painting unit 4 is arranged between the reaction liquid application unit 2 and the image formation unit 3, and FIG. 4, another configuration in which the white ink painting unit 4 is arranged between the ink image processing unit 5 and the transfer unit 6. Incidentally, the configuration of FIG. 3 can be suitably used where a transparent medium, such as a back print, is used as the recording medium 9 as will be described afterwards.

As hitherto described, this embodiment has a configuration in which the reaction liquid application unit 2 applies the reaction liquid 16 onto the transfer drum 1, which is an intermediate transfer body, and ink is applied to that applied area by the image formation unit 3 to form an ink image. This makes possible formation of a coagulated ink image 20 restrained in beading and bleeding on the transfer drum 1. By applying white ink to this coagulated ink image 20 with the white ink painting unit 4, the concealability of the color and pattern of the recording medium can be enhanced relative to the coagulated ink image 20. By transferring this coagulated ink image 20 to which white ink has been applied to the recording medium, it is made possible to obtain a satisfactory image which is unaffected by the color and pattern of the background on the recording medium and vividly and faithfully reproduces the colors.

To add, the above-described embodiment has a configuration in which the white ink painting unit 4 is positioned opposite the ink image formed by the image formation unit 3 on the transfer drum only once and white ink is applied to that ink image from the white ink painting unit 4 only once during that only encounter. However, to further improve the concealment by the white ink, it is effective to position the white ink painting unit 4 opposite a plurality of times the ink image formed by the image formation unit 3 on the transfer drum and to apply white ink from the white ink painting unit 4 during the plurality of encounters. Since in this case it is necessary to position the image in a state in which white ink is applied to the ink image opposite the white ink painting unit 4 again, the units in contact with the transfer drum (the reaction liquid application unit 2, the transfer unit 6 and the cleaning unit 8) should be moved away from the transfer drum. This enables white ink to be applied over the ink image on the transfer drum a plurality of times. As the ink image on the transfer drum is then deprived of moisture in the ink by the ink image processing unit, the image is not disturbed by a large amount of moisture even though the white ink is applied a plurality of times, making it possible to increase the concealability.

To add, the foregoing description referred to a mode in which a material to reduce the fluidity of ink is applied as treatment to make the ink on the intermediate transfer body less fluid, this is not the only means to achieve the purpose. Treatment to make the ink on the intermediate transfer body less fluid may as well be, for instance, heat treatment to accelerate the drying of the ink image formed on the intermediate transfer body or moisture reduction in the ink image formed on the intermediate transfer body by using a sponge or the like.

EXAMPLES

This embodiment will be described below in more specific terms with reference to examples and comparative examples. In the following description, "part(s)" as numerical units and percentages are stated on a mass basis unless otherwise stated. All the inks and reaction liquids used are adjusted with water, and their respective total quantities are counted as 100 parts each.

[Preparation of Pigment Inks]

First, pigment inks of black, cyan, magenta and yellow, each containing a pigment and an anionic compound, were prepared as described below.

(Preparation of Pigment Ink)

<Preparation of Pigment-dispersed Liquid>

| | |
|---|---|
| Styrene-acrylic acid-acrylic acid ethyl copolymer (240 in acid value; weight-averaged molecular weight = 5,000) | 1.5 parts |
| Monoethanolamine | 1.0 parts |
| Diethylene glycol | 5.0 parts |
| Ion-exchange water | Remaining parts |

The above-listed components were mixed, and the mixture was heated to 70° C. in a water bath to completely dissolve the resin content. 10 parts of carbon black (MCF88, a product of Mitsubishi Chemical), newly produced on a trial basis and 1 part of isopropyl alcohol were added to this solution, and the mixture, after premixing for 30 minutes, was subjected to dispersion processing.

Dispersing machine: Sand grinder (a product of Igarashi Kikai)

Crushing media: Zirconium beads, 1 mm in diameter

Loading ratio of crushing media: 50% (in volume terms)

Crushing duration: 3 hours

Further, coarse particles were removed by centrifugal separation (for 20 minutes at 12,000 rpm) to obtain a black pigment-dispersed liquid.

<Preparation of Ink>

This dispersed liquid was used, to which components were added in the following ratio to prepare ink containing a pigment and a black pigment ink K1 was thereby obtained. This ink was found to have a surface tension of 34 mN/m.

| | |
|---|---|
| This pigment-dispersed liquid | 30.0 parts |
| Glycerin | 10.0 parts |
| Ethylene glycol | 5.0 parts |
| N-methyl pyrrolidone | 5.0 parts |
| Acetylenol EH (product of Kawaken Fine Chemicals) | 1.0 part |
| Ion-exchange water | Remaining parts |

(Preparation of Pigment Ink C1)

Cyan-colored pigment ink C1 was prepared by the same method as that of preparing pigment ink K1 except that 10 parts of carbon black (MCF88, a product of Mitsubishi Chemical) used for pigment ink K1 were replaced by pigment Blue 15.

(Preparation of Pigment Ink M1)

Magenta-colored pigment ink M1 was prepared by the same method as that of preparing pigment ink K1 except that 10 parts of carbon black (MCF88, a product of Mitsubishi Chemical) used for pigment ink K1 were replaced by pigment Red 7.

(Preparation of Pigment Ink Y1)

Yellow-colored pigment ink Y1 was prepared by the same method as that of preparing pigment ink K1 except that 10 parts of carbon black (MCF88, a product of Mitsubishi Chemical) used for pigment ink K1 were replaced by pigment yellow 74.

[Preparation of Reaction Liquids]

Next, reaction liquids respectively containing polyvalent metallic salt and a surfactant were prepared.

(Preparation of Reaction Liquid R1)

After the following components were mixed and dissolved, the mixture was filtered under pressure with a membrane filter of 0.22 μm in pore size (Floroporefilter in commercial product name; a product of Sumitomo Electric Industries) to obtain reaction liquid R1.

| | |
|---|---|
| Diethylene glycol | 10.0 parts |
| Methyl alcohol | 5.0 parts |
| Calcium hydrochloride dihydrate | 5.0 parts |
| SurflonS-141 (commercial name; a product of Seimi Chemical Co., Ltd.) | 1.0 part |
| Ion-exchange water | Remaining parts |

[Preparation of White Ink]

Next, white inks respectively containing a resin and a surfactant were prepared.

(Preparation of White Ink W1)

White ink W1 was prepared by the same method as that of preparing pigment ink K1 except that 10 parts of carbon black (MCF88, a product of Mitsubishi Chemical) used for pigment ink K1 were replaced by anatase titanium dioxide.

| | |
|---|---|
| This pigment-dispersed liquid | 30.0 parts |
| Glycerin | 10.0 parts |
| Ethylene glycol | 5.0 parts |
| N-methyl pyrrolidone | 5.0 parts |
| Acetylenol EH (product of Kawaken Fine Chemicals) | 1.0 part |
| Ion-exchange water | Remaining parts |

(Preparation of White Ink W2)

Components were mixed in the following composition ratio to prepare white ink W2.

| | |
|---|---|
| Ethylene-bis-melamine (Shigenox OWP in commercial product name; a product of Hakko Chemical Kabushiki Kaisha) | 20.0 parts |
| Hexylene glycol | 10.0 parts |
| Ethylene glycol | 5.0 parts |
| N-methyl pyrrolidone | 5.0 parts |
| Acetylenol EH (product of Kawaken Fine Chemicals) | 1.0 part |
| Ion-exchange water | Remaining parts |

(Preparation of White Ink W3)

Components were mixed in the following composition ratio to prepare white ink W3.

| | |
|---|---|
| Titanium oxide | 15.0 parts |
| Rosin-denatured xylene resin | 30.0 parts |
| Cyclohexanone | 40.0 parts |
| Ethanol | 15.0 parts |

These components were dispersed by processing with a sand mill, followed by the addition of 50 parts of ethanol and 2.0 parts of sodium thiocyanate and stirring for 30 minutes with a ball mill. Coarse particles were removed by suction filtration with a 3 μm filter. Further, 40 weight parts of methyl ethyl ketone containing 0.5 weight part of zinc caprylate were added, followed by stirring.

Example 1

In this example, an image was formed by using the ink jet recording apparatus embodying the invention in this mode, shown in FIG. 1. In this image formation attempt, reaction liquid R1 and pigment inks K1, C1, M1, and Y1 prepared as described above were used. First, after the transfer drum 1 was coated with reaction liquid R1 to a thickness of above 2 μm, pigment ink Y1, M1, C1, and K1 were sequentially applied with the recording heads 18 to form a coagulated ink image 20 on the transfer drum 1.

In this sequence, each pigment ink on the transfer drum 1 was reacting with reaction liquid R1, and an image formed on the transfer drum 1 was found satisfactory, free from beading. Every time the ink of another color was superposed, coagulation immediately took place with no undesired phenomenon of beading or bleeding, and the image formed on the transfer drum 1 was confirmed to have high picture quality.

Next, white ink W1 was ejected from the white ink applying recording head 19 and applied over the coagulated ink image 20 of high picture quality on the transfer drum 1. Further, the solvent content of the coagulated ink image 20 was evaporated by blowing air from the air knife 22 at the next step. After that, the transfer unit 6 transferred the coagulated ink image 20 on the transfer drum 1 to the blue-colored recording medium 9 fed by the carriage rollers 24*a* and 24*b*, and a printed sheet was thereby produced. Further, the image on this printed sheet fixed by being passed through the carriage/fixation rollers 29*a* and 29*b* heated at a temperature of 150° C. The finally obtained color image not only had high picture quality but also was well fixed, free from ink blurs even when rubbed immediately after the sheet was discharged. Furthermore, the image was not only free from beading and bleeding but also looked vivid, unaffected by the background color of the blue recording medium.

The recording heads 18 and the white ink applying recording head 19 had a recording density of 1,200 dpi, and their driven conditions included a drive frequency of 10 kHz. Each of the heads used had an ejection volume of 4 pl per dot.

Example 2

In this example, image formation was attempted on a transparent base by using the ink jet recording apparatus embodying the invention as illustrated in FIG. 3.

Immediately after the transfer drum 1 was coated with the earlier prepared reaction liquid R1 by the reaction liquid application unit 2, white ink W2 was ejected onto the intermediate transfer body by the white ink applying recording head 19. After that, the recording heads 18 applied pigment inks K1, C1, M1 and Y1 to the transfer drum 1 to form an image on the transfer drum 1. As a result, like in Example 1, a coagulated ink image of high picture quality was formed on the transfer drum 1. That coagulated ink image was transferred to the transparent base, which was the recording medium in this case. The result was satisfactory, with the final printed sheet after the transfer again proving excellent in picture quality.

This example would prove useful where the image is to be viewed from the side reverse to the face on which the image is formed. In this case, white ink performs the role of highlighting the formed image (in more detail, the role of enhancing the coloring efficiency of the formed image).

Example 3

In this example, formation of an image on a transparent base was attempted by using the ink jet recording apparatus embodying the invention as illustrated in FIG. 4. Immediately after the transfer drum 1 was coated with the earlier prepared reaction liquid R1 by the reaction liquid application unit 2, an image was formed on the transfer drum 1 by applying pigment inks K1, C1, M1 and Y1 with the recording heads 18. As a result, like in Example 1, a coagulated ink image of high picture quality was formed on the transfer drum 1. After that, immediately after the liquid content was removed from the coagulated ink image by the white ink image processing unit 5, white ink W3 was applied to the coagulated ink image 20 on the transfer drum 1 by the white ink applying recording head 19. After that, the coagulated ink image 20 to which the white ink was applied was transferred to the transparent base, which is the recording medium, heating the transfer drum 1 and the transfer roller 26 at these steps would further enhance the rate of transfer. The temperature in this process was adjusted to between 50° C. and 60° C. The use of this oily or solvent-based white ink would enable an image of high picture quality to be formed with even stronger concealing performance.

In this example, since white undercoating is done, the colors of the image formed on the white can be made more vivid.

Second Embodiment

This embodiment forms on the recording medium, in advance of the step to transfer the ink image formed on the transfer drum as the intermediate transfer body, the white undercoat for reducing the influences of the color and pattern of the recording medium or highlighting the image formed on the recording medium.

Figure 5:
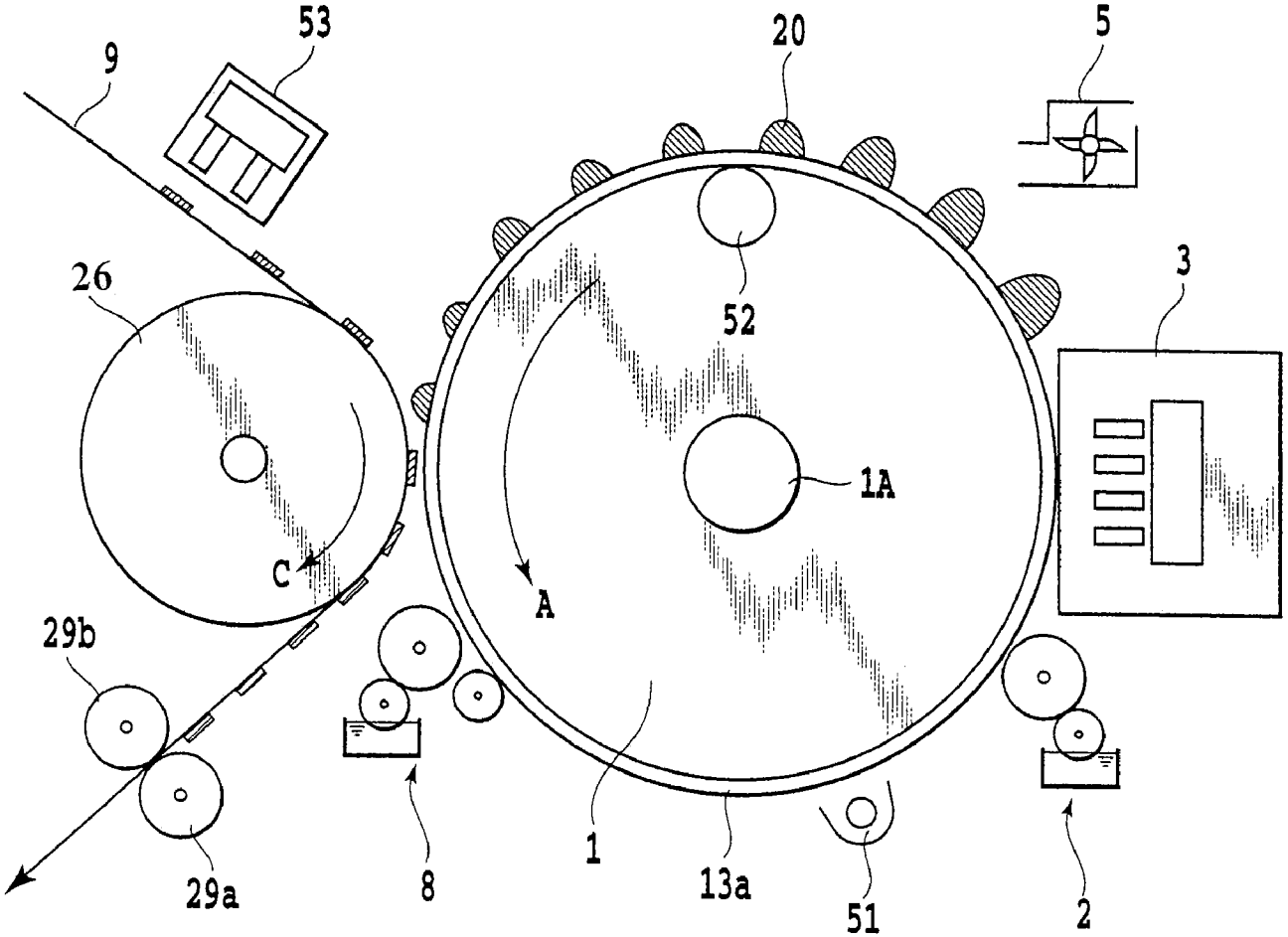
FIG. 5 is a schematic diagram showing the configuration of an image formation unit of an ink jet recording apparatus, in accordance with an another embodiment of the invention.

FIG. 5 is a schematic diagram showing the configuration of an image formation unit of an ink jet recording apparatus, which is another preferred embodiment of the invention. In FIG. 5, the same devices as those used in FIG. 1 and their constituent members are denoted by respectively the same reference signs as those of their counterparts in FIG. 1, and their description will be dispensed with.

In FIG. 5, the transfer drum 1 is an intermediate transfer body driven to rotate around a shaft 1A in direction of arrow A, and has the surface layer 13*a* on its outside. Reference numeral 51 in FIG. 5 denotes a hydrophilic processing device; the transfer drum 1 rotates in the direction of arrow A; and the surface of the surface layer 13*a* is reformed as required.

After that, the reaction liquid application unit 2 arranged in contact with the surface of the transfer drum 1 applies reaction liquid to the transfer drum 1 whose surface is reformed. Further, after the reaction liquid is applied, ink droplets are ejected from the image formation unit 3 and impact the transfer drum 1 to form an ink image 20, resulting in the formation of an ink image (mirror image) on the surface of the transfer drum 1.

On the other hand, a white undercoat is formed by an undercoat processing unit 53 in the area of the recording medium 9 to which the image is to be transferred. By bringing the recording face, where white undercoat is formed, of the recording medium 9 into contact with the ink image 20 formed on the transfer drum 1 and applying pressure on it with the transfer roller of the transfer unit 6, the image is transferred to and formed on the recording medium 9.

To add, the marking technique of adjusting the image position to superpose the ink image 20 formed on the transfer drum 1 and the white undercoat formed on the recording medium 9 without being out of register and other such aspects can rely on conventionally known means.

In the apparatus illustrated in FIG. 5, the ink image processing unit 5 is arranged for the purpose of evaporating the moisture or solvent content in the ink constituting the image on the transfer drum 1. Along with or instead of this, a heating roller 52, which is to perform heating in contact with the rear side of the hollow transfer drum 1, can be used as well.

The recording medium 9 on which an image has been formed via the transfer drum 1 in the manner described above can be given excellent surface smoothness by applying pressure with the carriage/fixation rollers 29*a* and 29*b*. The printed sheet can be promptly made sturdy by heating with the carriage/fixation rollers 29*a* and 29*b*.

Further in the configuration shown in FIG. 5, the transfer drum 1 after the ink image 20 formed on it has been transferred to the recording medium 9 is cleaned by the cleaning unit 8 in preparation of the next round of image formation.

Figure 6:
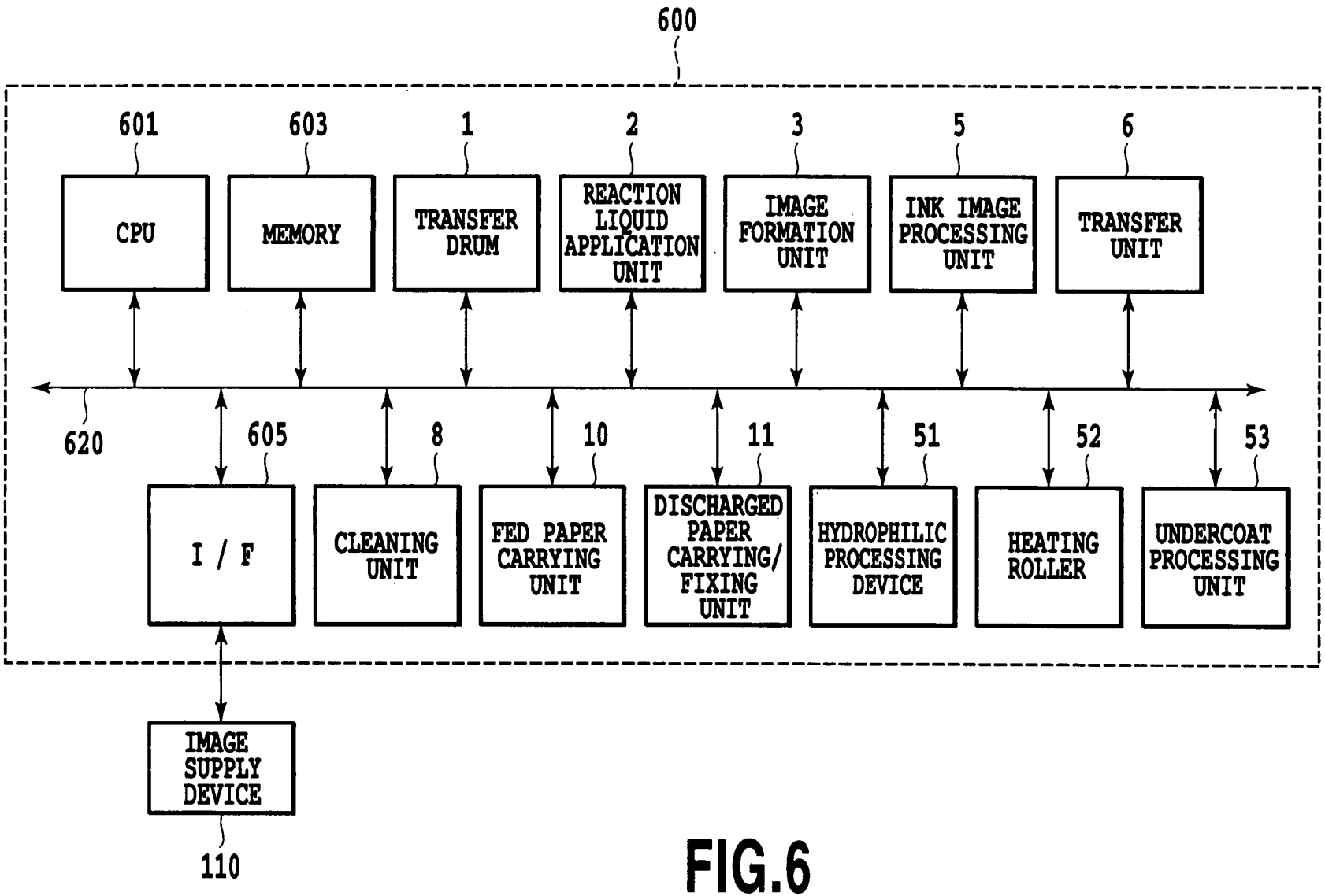
FIG. 6 is a schematic block diagram showing the configuration of a control unit in accordance with an embodiment of the invention.

FIG. 6 is a schematic block diagram showing the configuration of a control unit in the preferred embodiment of the invention. Referring to FIG. 6, in the ink jet recording apparatus of which the whole is denoted by reference numeral 600, a CPU 601 executes control processing for the operation of this ink jet recording apparatus and data processing. A memory 603 has an ROM (not shown) storing programs for those processing procedures and a RAM (not shown) to be used as a work area for executing those procedures among other purposes. An I/F 605 is an interface for exchanging information, including data and commands between the ink jet recording apparatus and the image supply device 110, which may be a host computer or the like serving as the supply source of image data.

In addition to the units described above, the transfer drum 1, reaction liquid application unit 2, image formation unit 3, ink image processing unit 5, transfer unit 6, cleaning unit 8, fed paper carrying unit 10, discharged paper carrying/fixing unit 11, hydrophilic processing device 51, heating roller 52 and undercoat processing unit 53 are connected to a bus line 620. Therefore, the CPU 601 can also exchange signals with various units via the bus line 620. Each of the units to be controlled is provided with a sensor for state detection, the detection signal from which can be communicated to the CPU 601 via the bus line 620.

Incidentally, unless image data supplied from the image supply device 110 are mirror-inverted data, the above-mentioned control unit performs inversion processing to generate mirror image data.

The ink jet recording apparatus embodying the invention in this mode comprises means of carrying out a step of forming an image on the transfer drum 1 by using the image formation unit 3 (hereinafter referred to as step (a)), a step of undercoating in white at least part of the recording medium 9 (hereinafter referred to as step (b)), and a step of transferring the ink image 20 formed on the transfer drum 1 to the recording medium 9 (hereinafter referred to as step (c). These steps (a) through (c) and means of their implementation will be described in detail below.

1. Step (a)

At step (a), an image is formed on the transfer drum 1. In this embodiment, the reaction liquid and the inks described with reference to the first embodiment can be used.

By forming an image on the transfer drum, which is the intermediate transfer body, an image of stable high quality unaffected by the ink-absorbency level of the recording medium can be formed. In this process, as described with reference to the first embodiment, if the transfer drum is coated with the reaction liquid ahead of applying any ink and a coagulated ink image is formed by bringing the ink and the reaction liquid into reaction with each other, the ink image formed on the transfer drum can be restrained in the occurrence of beading or bleeding. Further by reducing the liquid content in the ink image on the transfer drum, the image can be transferred without distortion even if the recording medium has no or little ink-absorbency.

Where the transfer drum 1 is to be coated with the reaction liquid ahead of applying any ink to the transfer drum 1 as described above, it is preferable to use a releasable material as the surface layer of the transfer drum 1 as described with reference to the first embodiment, it may be impossible to evenly apply the reaction liquid to the surface layer 13*a*. Therefore, in order to provide a uniform application of the reaction liquid, it is preferable to have the hydrophilic processing device 51 perform hydrophilic treatment for increasing the wettability (surface energy) of the surface layer 13*a* of the transfer drum 1 before applying the reaction liquid before applying the reaction liquid to the transfer drum 1.

At step (a) of this embodiment, the surface of the transfer drum 1 having the releasable surface layer 13*a* is reformed by having the hydrophilic processing device 51 work on it. As stated above, a releasable material is generally weak in critical surface tension, and would repel ink, reaction liquid or other liquids. Therefore, to enable the transfer drum 1 to be evenly applied ink and the reaction liquid, the repellence of ink and the reaction liquid is restrained by reforming the surface with the hydrophilic processing device 51.

The suitable means of hydrophilic treatment may be to apply liquid containing a surfactant to the surface of the transfer drum 1 or to reform the surface of the transfer drum 1 by providing energy to the surface. Combined use of these means is also possible.

Any surfactant can be used. It may be, for instance, a cationic surfactant, anionic surfactant, nonionic surfactant, ampholytic surfactant, fluoric surfactant or silicone-based surfactant. Especially, the releasable surface layer 13*a* which is cited as being preferable for use in this embodiment has a low surface energy configuration. For this reason, it is more preferable to use a fluorne or silicone-based surfactant. Though there is no particular limitation regarding the means of applying a surfactant, the use of a roll coater is advisable because a surfactant can adequately function even in a thin film form.

As the means of providing energy, any means generally capable of hydrophilic treatment, such as irradiation with ultraviolet rays, flame treatment, corona discharge treatment and plasma treatment, can be used without restriction. Of these examples, plasma treatment at either atmospheric or reduced pressure is particularly suitable, especially where the releasable surface layer is made of a material containing a fluoric compound or a silicone compound. These combinations are not only useful for hydrophilic treatment, but also will prove to have, at a subsequent step of transferring the ink image formed on the transfer drum to the recording medium, an effect of preventing the rate of transfer from falling or even enhancing the rate. The plasma treatment in this context includes part of corona discharge treatment by which oxygen in the atmosphere is activated and hydroxyl groups are generated on the surface of the treated base. The fluorine compounds and silicone compounds in this context have oil contents.

The mechanism which provides a more appropriate effect with a material selected in this way and surface reforming means selected has not yet been fully elucidated. However, it is an evident tendency that in the presence of fluorine or silicone-based oil content the hydrophilicity of the surface and the rate of transfer can be compatibly maintained or even improved or that another round of treatment would make these effects sustainable. From these findings, it is presumable that the chemical action (introduction of surface hydrophilic groups), generally believed to be the effect of plasma treatment makes at least part of the rubber, filler and oil contents hydrophilic and, in addition to that, the physical action (increasing the surface coarseness) gives rise to a change in part of the rubber structure and thereby facilitates the surface shifting of the oil content.

The suitable form of treatment would be to use a material surface-reformed in advance as the surface layer of the transfer drum or to dispose energy providing means within the apparatus and reform the surface at regular intervals, or the combination of both.

Incidentally, where the method of applying a surfactant and that of providing energy are used in combination as the means of hydrophilic treatment, it is more effective to provide energy first and then apply the surfactant.

An ink image is formed on the intermediate transfer body by using these materials and methods. Water and volatile organic solvent, which are liquid components of the ink image that is formed, are concentrated by evaporation. However, where high speed outputting is desired, natural evaporation conceivably may prove insufficient in concentration. With this possibility being taken into consideration, it is desirable to arrange the ink image processing unit 5 between ink image formation and transfer as shown in FIG. 1, and to facilitate the removal of moisture in the ink with such a device. Effective means of facilitating the removal of moisture would be, besides the ink image processing unit 5, blowing air toward or heating the ink image formation surface, bringing the heating roller 52 into contact from the rear side of the hollow transfer drum 1 as shown in FIG. 5, or heating the transfer roller 26.

Although applying the reaction liquid is done after the transfer drum 1 undergoes hydrophilic treatment by the hydrophilic processing device 51 in this embodiment, the hydrophilic processing device 51 can be dispensed with.

2. Step (b)

Step (b) is a step of undercoating a prescribed area of the recording medium with white.

Undercoating in this embodiment means the formation of a white undercoat by the undercoat processing unit 53, shown in FIG. 5, in the area of the recording medium surface to which the ink image 20 is to be transferred. This white undercoat can improve the concealment of the color and pattern of the image formation part of the recording medium. Therefore, by transferring an ink image to a recording medium over which such a white undercoat is formed, that image can prove satisfactory, less affected by the color and pattern of the recording medium.

Further in this embodiment, the rate of transfer from the transfer drum 1 to the recording medium 9 at the transferring step can be enhanced by providing the white undercoat at least part, or preferably the whole, of the area of recording medium to which the ink image 20 is to be transferred.

In pursuit of a higher rate of transfer, various proposals have been made. Japanese Patent Application Laid-Open Nos. 6-199032 (1994) and 7-133451 (1995) propose methods of enhancing the rate of transfer by providing on the intermediate transfer body a peel-off layer to facilitate peeling the ink off the intermediate transfer body in the transfer process. However, a liquid layer, which is the peel-off layer, on the intermediate transfer body would prevent the ink image formed thereon from being fixed. As a consequence, the ink image would be degraded by "distortion" or "oozing" that would arise, or "displacement" resulting from the transfer pressure applied at the time of transfer. Furthermore, the presence of the liquid layer would necessitate drying of the ink image without drying the liquid layer, and this would obstruct drying of the ink image, adversely affecting the speed of the process and the sturdiness of the image.

On the other hand, Japanese Patent Application Laid-Open No. 6-40025 (1994) discloses an apparatus in which ink droplets are jetted from ink jet recording heads onto an intermediate transfer body, ink is concentrated by having this intermediate transfer body absorb the solvent in the ink, and the ink image is transferred to a recording medium. However, this apparatus involves problems such as it taking time to absorb the solvent and absorption holes provided in the intermediate transfer body to absorb the solvent become clogged. Furthermore, as the absorbed ink solvent remains on the intermediate transfer body, there is a problem that unevenness of the image occurs between the part where the ink solvent is present and the part where it is absent. Means to remove the absorbed ink solvent would also be needed. This means a problem of substantial energy consumption to restore the initial state of the intermediate transfer body including the absorption of the solvent.

Thus, many different methods have been proposed to enhance the rate of transfer, but there remain unsolved problems.

This embodiment can provide the effect of improving the transfer acceptance of a recording medium, which would otherwise pose difficulty to receive the transfer of an ink image from the transfer drum 1 by providing a white undercoat over the area of the recording medium where the ink image 20 is to be transferred. Therefore, even if the recording medium 9 is white, the rate of transfer can be enhanced by undercoating the medium, making it possible to supply an image of higher grade. A recording medium which would pose difficulty to receive the transfer of an ink image from the transfer drum is, more specifically, a recording medium whose surface is rough (rugged) or a recording medium whose ink-absorbency is poor. In order to enhance the rate of transfer of any such recording medium, a white undercoat formed over the recording medium surface would effectively improve at least either of the surface smoothness and the surface stickiness of the recording medium.

1) Improvement of Surface Smoothness

The rate of transfer of ink is influenced by the area of contact between the ink on the transfer drum and the surface of the recording medium. Convex parts of a rough-surfaced recording medium, such as plain paper, traditional Japanese paper, pulp paper or embossed paper, can efficiently come into contact with ink on the transfer drum, but concave parts are smaller in the area of contact with ink on the transfer drum, namely lower in the rate of transfer. Thus, the more coarse the surface, the lower the rate of transfer. Therefore, in order to raise the rate of transfer, it is necessary to expand the area of contact, i.e. to smoothen the surface of the recording medium.

Therefore, if the surface of the white undercoat formed ahead of the transferring step is smoothened relative to the base of the recording medium, the area of contact between the ink image on the transfer drum and the recording medium can be enlarged, making it possible to enhance the rate of transfer.

2) Making the Surface More Sticky

The rate of transfer of ink is affected by any difference in surface energy between the transfer drum and the recording medium. If the internal coagulating force of the coagulated ink image(film) formed on the transfer drum is sufficiently strong, the ink image will move, at the time of transfer, to either of the transfer drum and the recording medium which come into contact via the ink image, whichever is higher in surface energy. Thus, the surface of the recording medium can be made more sticky to the coagulated ink image correspondingly to the surface energy, and the rate of transfer can be enhanced accordingly.

Then, if the surface of the white undercoat formed ahead of the transferring step is formed to be sticky to the base of the recording medium, the surface energy of the ink-applied part of the recording medium can be enhanced.

Or conversely, by so making the surface of the white undercoat formed ahead of the transferring step as to increase the stickiness of the coagulated ink image on the transfer drum 1, the surface energy of the ink image can be enhanced.

Specific methods of undercoating include one by which a white film is formed by sticking a film, such as a white thermal transfer film or a laminate film, to part or the whole of the recording medium, another by which a white toner film is formed by an electrophotographic system, and still another which a liquid containing a white coloring agent or some other solid component or white ink is applied to part or the whole of the recording medium.

Where undercoating is to be accomplished by sticking a film, a usual thermal transfer printer or a hot or cold laminator device can be directly used as the undercoat processing unit 53. If a white undercoat is to be formed of a white toner film, a usual monochrome electrophotographic image recording device can be used in combination with a white toner to constitute an undercoating unit. It would be effective to form the part where the white undercoat is to be formed in the same shape as the image part or, where the undercoat is to be part of the recording medium, to use a thermal transfer system or an electrophotographic system. In any of these cases, it is obviously necessary to tune the image data to be formed on the transfer drum with the data of the undercoat area (also referred to as undercoating data). Where a thermal transfer film is used as the undercoat, surface stickiness can as well be achieved by heating it at the time of image transfer to re-melt it.

Where undercoating is to be accomplished by applying liquid, the undercoat processing unit 53 includes an undercoating liquid applying device. It may also include a drying device and a surface smoothening device. Although the undercoating liquid applying device is subject to no particular restriction as to its applying means or form, a roll coater or a spray would be suitable where coating or application is to cover the whole surface of the recording medium. Where application is to selectively cover the recording medium, a recording head ejecting an ink undercoating liquid by the ink jet system would be suitable. Where a recording head is to be used, the white ink applying recording head 19 described with reference to the first embodiment can be used. Since in this case the undercoating liquid can be selectively applied onto the recording medium, it allows adaptation to the characteristics of the image to be formed and accordingly is more preferable. Where a recording head is to be used for undercoating, the recording head applies the undercoating liquid to the recording medium according to undercoating data.

The drying unit, though selected according to the undercoating liquid to be used, usually is a drier device having a heater and an air blower. Available methods include one seeking smoothness alone, by which the undercoating liquid is completely dried, and another seeking both smoothness and stickiness, by which the undercoating liquid is not completely dried. Obviously, the latter is more preferable. Where such a state can be achieve by natural drying, the drying unit can be dispensed with.

In very rare cases, leveling of the undercoating liquid alone cannot provide a sufficiently smooth surface. In such a case, a surface smoothening unit, more specifically a metallic mirror-surfaced roller whose surface is treated with Teflon (registered trademark), can be used, and smoothness can be achieved pressing the surface of the recording medium with that roller.

The undercoating liquid for use in this embodiment mainly consists of a white color material, solvent and resin, the minimum composition consisting of a white color material and solvent. Incidentally, the undercoating liquid for use in this embodiment need not be aqueous. The white ink described with reference to the first embodiment is appropriate as such undercoating liquid.

Next will be described a case in which a thermal transfer system is used for undercoating.

Figure 7:
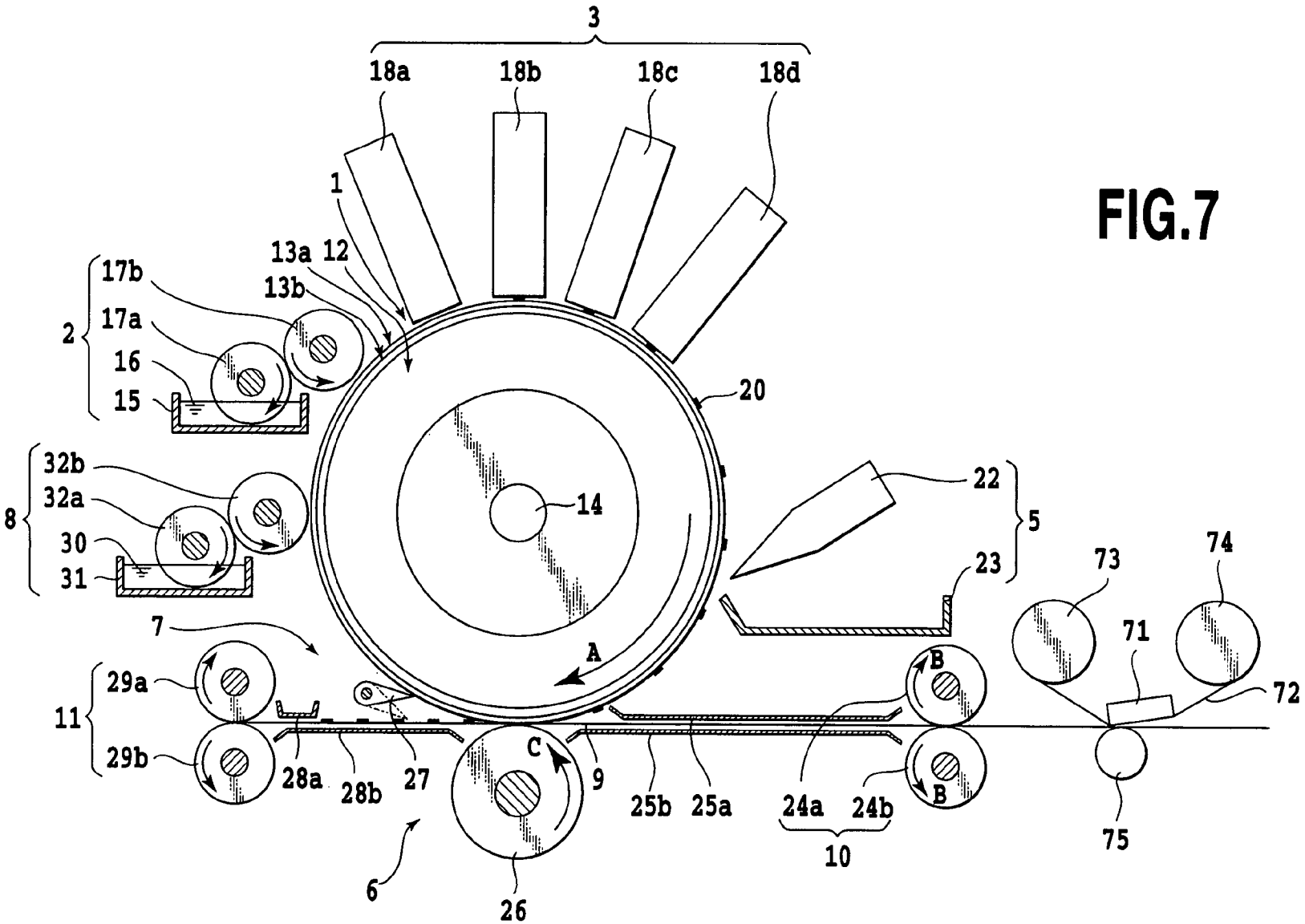
FIG. 7 is a schematic diagram showing further configuration of the image formation unit of the ink jet recording apparatus, in accordance with an embodiment of the invention.

FIG. 7 shows another configuration of the image formation unit of the ink jet recording apparatus embodying the invention in this mode. Referring to FIG. 7, the undercoat processing unit 53 comprises a line type thermal head 71, a white ink donor film 72, a white ink donor film feed roller 73, a white ink donor film take-up roller 74 and a platen roller 75.

In this configuration, heat emission by the heating element of the line type thermal head 71 according to undercoating data causes white ink to be thermally transferred from the white ink donor film 72 to the area of the recording medium 9 where the ink image 20 is to be transferred.

Incidentally, where the resolution of the recording heads 18 of the image formation unit 3 differs from that of the line type thermal head 71, the image signals can be adjusted by any appropriate known means.

In this embodiment, the undercoating data are data for forming a white undercoat in the area of the recording medium 9 to which the ink image 20 is to be transferred (the area where the image is formed). Like the white ink data described with reference to the first embodiment, they are obtained by calculating the logical sum of data matching different colors delivered to the image formation unit 3, and these data are generated by the control unit. According to the created undercoating data, where the undercoat processing unit 53 is a recording head for instance, the recording head applies an undercoating liquid, such as white ink, to a prescribed area of the recording medium to form a white undercoat.

Incidentally, the area in which the white undercoat is to be formed in this embodiment is at least where color ink dots are applied among the areas covered by the ink image 20 transferred to the recording medium 9. Therefore the control unit, like its counterpart in the first embodiment, creates undercoating data according to the desired area of white undercoat formation.

3. Step (c)

Step (c) is a step of transferring the ink image 20 formed on the transfer drum 1 to the recording medium 9.

At step (c), the recording medium 9 accepts ink as it is brought into contact with the image formation surface of the transfer drum 1 by the transfer roller of the transfer unit 6. Then, the transfer is achieved as the transfer roller presses the recording medium 9 relative to the transfer drum 1. In this embodiment, as the ink image on the transfer drum 1 is concentrated, reduce both in volume and in fluidity, the distortion of the image due to the pressure is alleviated. The effect of this concentration enables a satisfactory image to be formed even on an undercoat of a liquid which would invite mixing of colors if the image were directly drawn or on an undercoat of a solid which would repel ink, provided by thermal transfer or electrophotographic recording. Furthermore, even on a colored recording medium, the effect of white undercoating of the recording medium would make possible vivid reproduction of colors. In addition, the effect of surface smoothing or making the surface sticky by the undercoating makes possible reception of the ink image on the intermediate transfer body at a stably high rate of transfer.

Moreover, the recording medium 9 on which the image has been formed via the transfer drum 1 is provided with a high level of surface smoothness by being pressed by the carriage/fixation rollers 29*a* and 29*b*. Further, the printed sheet can be promptly made sturdy by heating the recording medium 9 with the carriage/fixation rollers 29*a* and 29*b*.

In the ink jet recording apparatus illustrated in FIG. 5, the transfer drum 1 having delivered the ink image is cleaned by the cleaning unit 8 arranged at the next stage. Desirably cleaning means include, in addition to the form described with reference to the first embodiment, washing with water or wiping with water-wet cloth while showering water on it, direct washing in contact with a water surface, and bringing a wet Moulton roller into contact. Of course, combination of these means could also be effective.

Furthermore, if necessary, it would also be effective to dry the surface of the transfer drum 1 after washing by bringing a Moulton roller into contact, blowing air or otherwise.

As hitherto described, since a white undercoat is formed by the undercoat processing unit 53 in a prescribed area of the recording medium ahead of the transferring step, the concealability of the color and pattern of the recording medium can be enhanced relative to the coagulated ink image 20 as in the first embodiment. Further by transferring the coagulated ink image 20 to the recording medium over which the white undercoat is formed, a satisfactory image vividly and faithfully reproducing the original colors can be obtained, unaffected by the color and pattern of the background of the recording medium.

Further by forming the white undercoat, at least either of the surface smoothness and the surface stickiness of the recording medium can be improved. Therefore, the coagulated ink image 20 formed on the transfer drum 1 can be transferred to the recording medium 9 at a high rate of transfer.

Although the foregoing description supposes application of a material to reduce the fluidity of ink as processing to make the ink on the intermediate transfer body less fluid, this is not the only available way. Processing to make the ink on the intermediate transfer body less fluid can be accomplished by, for instance, heating to accelerate the drying of the ink image formed on the intermediate transfer body or moisture reduction in the ink image formed on the intermediate transfer body by using a sponge or the like.

Also, processing to make the ink on the intermediate transfer body less fluid can be dispensed with in this embodiment.

EXAMPLES

This embodiment will be described below in more specific terms with reference to examples and comparative examples. In the following description, "part(s)" as numerical units and percentages are stated on a mass basis unless otherwise stated. All the inks and reaction liquids used are adjusted with water, and their respective total quantities are counted as 100 parts each.

Example 4

(a) Formation of Ink Image on Transfer Drum

In this example, an aluminum-made drum coated with silicone rubber (a product of Shin-Etsu Chemical: KE12) of 40° in rubber hardness to a thickness of 0.3 mm was used as the transfer drum. First, the surface of this transfer drum was reformed under the following conditions by using an atmospheric pressure irradiation apparatus (a product of Keyence Corporation: ST-7000).

Irradiation distance: 5 mm

Plasma mode: High

Processing speed: 20 mm/sec

Next, a reaction liquid consisting of a 5 mass % aqueous solution of calcium chloride dihydrate to which 0.5% of fluoric surfactant Surflon S-141 (commercial name; a product of Seimi Chemical Co., Ltd.) was added was applied onto the transfer drum with a roller coater. After that, a mirror-inverted character image was formed of yellow ink on the transfer drum whose surface was coated with the reaction liquid by using an ink jet recording head (1200 dpi in nozzle density, 4 pl in ejection volume, 12 kHz in drive frequency). An ink of the following composition was used in this case.

| | |
|---|---|
| Following pigment<br>Yellow: Pigment yellow 74 | 3 parts |
| Water-soluble resin<br>Styrene-acrylic acid-acrylic acid ethyl copolymer<br>(240 in acid value, 5000 in weight-averaged molecular weight) | 1 part |
| Glycerin | 10 parts |
| Ethylene glycol | 5 parts |
| Surfactant<br>(Acetylenol EH, a product of Kawaken Fine Chemicals) | 1 part |
| Ion-exchange water | 80 parts |

Then, warm air of 50° C. was blown for 2 seconds on the coagulated ink image on the transfer drum to reduce moisture in the ink.

(b) Undercoating of Recording Medium

On the other hand, the following undercoating agent (white ink) was applied to only the character image accepting part (the area corresponding to image data) of a recording medium (Toyo Cotton's "Koi-ao" (dark blue); 104.7 g/m$^2$) with an ink jet recording head (600 dpi in nozzle density, 10 pl in ejection volume, 6 kHz in drive frequency).

| | |
|---|---|
| Following pigment<br>Anatase titanium dioxide | 10 parts |
| Water-soluble resin<br>Styrene-acrylic acid-acrylic acid ethyl copolymer<br>(180 in acid value, 4500 in weight-averaged molecular weight) | 1 part |
| Glycerin | 3 parts |
| Ethylene glycol | 3 parts |
| Surfactant<br>(Acetylenol EH, a product of Kawaken Fine Chemicals) | 1 part |
| Ion-exchange water | 82 parts |

Then, warm air of 50° C. was blown for 2 seconds on the undercoating agent on the recording medium to reduce moisture in the agent.

(c) Transfer of Ink Image

The surfaces of the transfer drum and the recording medium were pressured in contact with each to transfer the character image on the transfer drum to the recording medium. In this case, the ink achieved almost 100% in the rate of transfer, and a clear yellow character image was formed on the recording medium.

Example 5

(a) Formation of Ink Image on Transfer Drum

In this example, like in Example 4, an aluminum-made drum coated with silicone rubber (a product of Shin-Etsu Chemical: KE12) of 40° in rubber hardness to a thickness of 0.3 mm was used as the transfer drum. First, the surface of this transfer drum was reformed under the following conditions by using an atmospheric pressure irradiation apparatus (a product of Keyence Corporation: ST-7000).

| | |
|---|---|
| Irradiation distance: | 5 mm |
| Plasma mode: | High |
| Processing speed: | 20 mm/sec |

Next, a reaction liquid consisting of a 5 mass % aqueous solution of calcium hydrochloride dehydrate to which 0.5% of silicone-based surfactant (a product of Nippon Unicar: L77) was added was applied onto the transfer drum with a roller coater. After that, a mirror-inverted photographic image was formed of inks of four colors on the transfer drum whose surface was coated with the reaction liquid by using an ink jet recording head (1200 dpi in nozzle density, 4 pl in ejection volume, 12 kHz in drive frequency). Inks of the following compositions were used in this case.

Following pigments 3 parts each

Black: Carbon Black (a product of Mitsubishi Chemical: MCF88)

Cyan: Pigment Blue 15

Magenta: Pigment Red 7

Yellow: Pigment yellow 74

| | |
|---|---|
| Water-soluble resin:<br>Styrene-acrylic acid-acrylic acid ethyl copolymer<br>(240 in acid value, 5000 in weight-averaged molecular weight) | 1 part |
| Glycerin | 10 parts |
| Ethylene glycol | 5 parts |
| Surfactant<br>(Acetylenol EH, a product of Kawaken Fine Chemicals) | 1 part |
| Ion-exchange water | 80 parts |

Then, warm air of 50° C. was blown for 2 seconds on the ink image on the intermediate transfer body to reduce moisture in the ink.

(b) Undercoating of Recording Medium

On the other hand, an area a size larger than the ink image accepting part (at least the area matching the image data) of the recording medium (Ten-color, black (***D color), 152.0 g/m$^2$) was undercoated by applying a heat-meltable white ink donor film with a line type thermal head (400 dpi in resolution).

(c) Transfer of Ink Image

The surfaces of the transfer drum and the recording medium were pressured in contact with each to transfer the photographic image on the transfer drum to the recording medium. In this case, the inks achieved almost 100% in the rate of transfer, and a satisfactory photographic image was formed on the recording medium.

Comparative Example 1

(a) Formation of Ink Image on Transfer Drum

Like in Example 4, an aluminum-made drum coated with silicone rubber (a product of Shin-Etsu Chemical: KE12) of 400 in rubber hardness to a thickness of 0.3 mm was used as the transfer drum. First, the surface of this transfer drum was reformed under the following conditions by using an atmospheric pressure irradiation apparatus (a product of Keyence Corporation: ST-7000).

| | |
|---|---|
| Irradiation distance: | 5 mm |
| Plasma mode: | High |
| Processing speed: | 20 mm/sec |

Next, a reaction liquid consisting of a 5 mass % aqueous solution of calcium hydrochloride dehydrate to which 0.5% of fluoric surfactant Surflon S-141 (commercial name; a product of Seimi Chemical Co., Ltd.) was added was applied onto the transfer drum with a roller coater. After that, a mirror-inverted character image was formed of yellow ink on the transfer drum whose surface was coated with the reaction liquid by using an ink jet recording head (1200 dpi in nozzle density, 4 pl in ejection volume, 12 kHz in drive frequency). An ink of the following composition was used in this case.

| | |
|---|---|
| Following pigment<br>Yellow: Pigment Yellow 74 | 3 parts |
| Water-soluble resin<br>Styrene-acrylic acid-acrylic acid ethyl copolymer<br>(240 in acid value, 5000 in weight-averaged molecular weight) | 1 part |
| Glycerin | 10 parts |
| Ethylene glycol | 5 parts |
| Surfactant<br>(Acetylenol EH, a product of Kawaken Fine Chemicals) | 1 part |
| Ion-exchange water | 80 parts |

Then, warm air of 50° C. was blown for 2 seconds on the coagulated ink image on the transfer drum to reduce moisture in the ink.

(b) Undercoating of Recording Medium

On the other hand, a recording medium (Toyo Cotton's "Koi-ao" (dark blue); 104.7 g/m$^2$) was used without undercoating.

(c) Transfer of Ink Image

The surfaces of the transfer drum and the recording medium were pressured in contact with each to transfer the photographic image on the transfer drum to the recording medium. In this case, the rate of transfer of the ink dropped to about 90%. Also, the character image formed on the recording medium turned green.

Comparative Example 2

(b) Undercoating of Recording Medium

On the other hand, an area a size larger than the ink image accepting part (at least the area matching the image data) of the recording medium (Ten-color, black (***D color), 152.0 g/m$^2$) was undercoated by applying a heat-meltable white ink donor film with a line type thermal head (400 dpi in resolution).

(d) Formation of Ink Image

A photographic image was formed directly formed on the undercoated area of the transfer drum by using an ink jet recording head (1200 dpi in nozzle density, 4 pl in ejection volume, 12 kHz in drive frequency). Inks of the following compositions were used in this case.

| | |
|---|---|
| Following pigments<br>Black: Carbon Black (a product of Mitsubishi Chemical: MCF88)<br>Cyan: Pigment Blue 15<br>Magenta: Pigment Red 7<br>Yellow: Pigment yellow 74 | 3 parts each |
| Water-soluble resin:<br>Styrene-acrylic acid-acrylic acid ethyl copolymer<br>(240 in acid value, 5000 in weight-averaged molecular weight) | 1 part |
| Glycerin | 10 parts |
| Ethylene glycol | 5 parts |
| Surfactant<br>(Acetylenol EH, a product of Kawaken Fine Chemicals) | 1 part |
| Ion-exchange water | 80 parts |

In this case, the ink droplets became mixed on the undercoated surface, and the image was greatly disturbed.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2004-166366 filed Jun. 3, 2004, which is hereby incorporated by reference herein.

What is claimed is:

1. An ink jet recording method comprising:

a liquid applying step of applying a liquid for reducing the fluidity of an ink to an intermediate transfer body, the intermediate transfer body having a surface to which a hydrophilic treatment by a plasma treatment has been performed;

an ink applying step of applying the ink to the intermediate transfer body to which the liquid has been applied with a first recording head according to image data;

a transferring step of transferring the ink applied to the intermediate transfer body to a recording medium; and a white material applying step of applying, ahead of said transferring step, a white material to at least part of a first area to which the ink has been applied on the intermediate transfer body or to at least part of a second area to which the ink is to be transferred on the recording medium.

2. The ink jet recording method according to claim 1, further comprising a step of accelerating the drying of the ink applied to the intermediate transfer body.

3. The ink jet recording method according to claim 1, wherein the liquid is a reaction liquid for making color materials in the ink coagulate.

4. The ink jet recording method according to claim 1, wherein in the white material applying step, the white material is applied to the first area or the second area with a second recording head according to data for applying the white material generated on the basis of the image data.

5. The ink jet recording method according to claim 4, wherein the data for applying the white material are obtained from the logical sum of color data for respective inks of a plurality of colors.

6. An ink jet recording method comprising:

a step of applying a liquid containing a component which coagulates color materials in an ink to an intermediate transfer body having a surface to which a hydrophilic treatment by a plasma treatment has been performed;

a step of applying the ink to the intermediate transfer body to which the liquid has been applied, with a recording head according to image data;

a step of applying a white material to at least part of an area to which the ink has been applied on the intermediate transfer body; and a step of transferring the ink and the white material applied to the intermediate transfer body to a recording medium.

7. An ink jet recording method comprising:

a liquid applying step of applying a liquid containing a component that coagulates color materials in an ink to an intermediate transfer body, the intermediate transfer body having a surface to which a hydrophilic treatment by a plasma treatment has been performed;

an ink applying step of applying the ink to the intermediate transfer body to which the liquid has been applied with a recording head according to image data;

a transferring step of transferring the ink applied to the intermediate transfer body to a recording medium; and a white material applying step of applying, ahead of said transferring step, a white material to at least part of an area to which the ink is to be transferred on the recording medium.

8. An ink jet recording apparatus comprising:

means for applying a liquid to coagulate color materials in an ink to an intermediate transfer body having a surface to which a hydrophilic treatment by a plasma treatment has been performed;

means for applying the ink to the intermediate transfer body to which the liquid has been applied according to image data;

a transferring portion for transferring the ink applied to the intermediate transfer body to a recording medium; and means for applying a white material to at least part of an area to which the ink has been applied on the intermediate transfer body.

9. An ink jet recording apparatus comprising:

means for applying a liquid to coagulate color materials in an ink to an intermediate transfer body having a surface to which a hydrophilic treatment by plasma treatment has been performed;

means for applying the ink to the intermediate transfer body to which the liquid has been applied according to image data;

transferring portion for transferring the ink applied to the intermediate transfer body to a recording medium; and means for applying a white material to at least part of an area to which the ink is to be transferred on the recording medium.

* * * * *

UNITED STATES PATENT AND TRADEMARK OFFICE

CERTIFICATE OF CORRECTION

PATENT NO. : 7,419,257 B2
APPLICATION NO. : 11/136382
DATED : September 2, 2008
INVENTOR(S) : Mouri et al.

It is certified that error appears in the above-identified patent and that said Letters Patent is hereby corrected as shown below:

COLUMN 4:
Line 26, “influences” should read --influences of--.
Line 45, “format ion” should read --formation--.

COLUMN 7:
Line 29, “be” should read --by--.
Line 61, “hands,” should read --hand,--.

COLUMN 8:
Line 27, “which” should be deleted.

COLUMN 9:
Line 20, “preferably” should read --preferably be--.

COLUMN 12:
Line 60, “indifferent” should read --in different--.

COLUMN 15:
Line 23, “by” should read --be--.

COLUMN 25:
Line 21, “before” (second occurrence) should be deleted.
Line 22, “applying the reaction liquid” should be deleted.
Line 43, “fluorne” should read --fluorine--.

COLUMN 29:
Line 2, “achieve” should read --achieved--.
Line 64, “reduce” should read --reduced--.

UNITED STATES PATENT AND TRADEMARK OFFICE

CERTIFICATE OF CORRECTION

PATENT NO. : 7,419,257 B2
APPLICATION NO. : 11/136382
DATED : September 2, 2008
INVENTOR(S) : Mouri et al.

It is certified that error appears in the above-identified patent and that said Letters Patent is hereby corrected as shown below:

COLUMN 33:
Line 66, "formed" (second occurrence) should be deleted.

Signed and Sealed this

Seventeenth Day of March, 2009

JOHN DOLL
*Acting Director of the United States Patent and Trademark Office*